US006460631B2

(12) United States Patent
Dykstra et al.

(10) Patent No.: US 6,460,631 B2
(45) Date of Patent: Oct. 8, 2002

(54) DRILL BITS WITH REDUCED EXPOSURE OF CUTTERS

(75) Inventors: Mark W. Dykstra, Kingwood; William Heuser, The Woodlands; Michael L. Doster; Theodore E. Zaleski, Jr., both of Spring; Jack T. Oldham, Willis; Terry D. Watts, Spring; Daniel E. Ruff, Kingwood; Rodney B. Walzel, Conroe; Christopher C. Beuershausen, Spring, all of TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/738,687

(22) Filed: Dec. 15, 2000

(65) Prior Publication Data

US 2001/0030063 A1 Oct. 18, 2001

Related U.S. Application Data

(63) Continuation-in-part of application No. 09/383,228, filed on Aug. 26, 1999, now Pat. No. 6,298,930.

(51) Int. Cl.[7] ..... E21B 10/46
(52) U.S. Cl. ..... 175/57; 175/428; 175/431
(58) Field of Search ..... 175/57, 363, 376, 175/378, 398, 428, 429, 431, 432

(56) References Cited

U.S. PATENT DOCUMENTS 1,805,678 A 5/1931 Smith
2,198,849 A 4/1940 Waxler
2,563,515 A 8/1951 Brown
2,624,549 A 1/1953 Wallace (List continued on next page.)

OTHER PUBLICATIONS

1995 Hughes Christensen Drill Bit Catalog, p. 31.

Hughes Christensen Bit Drawing dated May 29, 1997—HC Part No. CC201918.

Hughes Christensen Bit Drawing dated Sep. 18, 1996—HC Part No. CW 210655.

Hughes Christensen Bit Drawing dated Sep. 18, 1996—HC Part No. CS205023.

Hughes Christensen Bit Drawing dated Sep. 9, 1996—HC Part No. CC201718.

*Primary Examiner*—Frank S. Tsay
(74) *Attorney, Agent, or Firm*—TraskBritt

(57) ABSTRACT

A rotary drag bit and method for drilling subterranean formations including a bit body being provided with at least one cutter thereon exhibiting reduced, or limited, exposure to the formation so as to control the depth-of-cut of the at least one cutter, so as to control the volume of formation material cut per bit rotation, as well as to control the amount of torque experienced by the bit and an optionally associated bottomhole assembly regardless of the effective weight-on-bit. The exterior of the bit preferably includes a plurality of blade structures carrying at least one such cutter thereon and including a sufficient amount of bearing surface area to contact the formation so as to generally distribute the weight of the bit against the bottom of the borehole without exceeding the compressive strength of the formation rock.

83 Claims, 22 Drawing Sheets

U.S. PATENT DOCUMENTS 2,684,835 A 7/1954 Moore
2,776,817 A 1/1957 Gregory et al.
3,153,458 A 10/1964 Short
3,303,894 A 2/1967 Varney
3,709,308 A 1/1973 Rowley et al.
3,779,323 A 12/1973 Horten et al.
3,915,246 A 10/1975 Sheshtawy
4,351,401 A 9/1982 Fielder
4,386,669 A 6/1983 Evans
4,499,958 A 2/1985 Radtke et al.
4,554,986 A 11/1985 Jones
4,718,505 A 1/1988 Fuller
4,763,737 A 8/1988 Hellnick
4,889,017 A 12/1989 Fuller et al.
4,932,484 A 6/1990 Warren et al.
4,981,184 A 1/1991 Knowlton et al.
4,982,802 A 1/1991 Warren et al.
4,991,670 A 2/1991 Fuller et al.
5,010,789 A 4/1991 Brett et al.
5,042,596 A 8/1991 Brett et al.
5,090,492 A 2/1992 Keith
5,111,892 A 5/1992 Sinor et al.
5,131,478 A 7/1992 Brett et al.
5,199,511 A 4/1993 Tibbitts et al.
5,244,039 A 9/1993 Newton, Jr. et al.
5,265,685 A 11/1993 Keith et al.
5,303,785 A 4/1994 Duke
5,314,033 A 5/1994 Tibbitts
5,388,649 A 2/1995 Ilomäki
5,402,856 A 4/1995 Warren et al.
5,447,208 A 9/1995 Lund et al.
5,531,281 A 7/1996 Murdock
5,549,171 A 8/1996 Mensa-Wilmot et al.
5,558,170 A 9/1996 Thigpen et al.
5,595,252 A 1/1997 O'Hanlon
5,653,300 A 8/1997 Lund et al.
5,663,512 A 9/1997 Schader et al.
5,730,234 A 3/1998 Putot

DRILL BITS WITH REDUCED EXPOSURE OF CUTTERS

RELATED APPLICATIONS

This application is a continuation-in-part of co-pending U.S. patent application entitled Drill Bits with Controlled Cutter Loading and Depth of Cut filed Aug. 26, 1999 and having Ser. No. 09/383,228.

BACKGROUND OF THE INVENTION

1. Field of the Invention

The present invention relates to rotary drag bits for drilling subterranean formations and their operation. More specifically, the present invention relates to the design of such bits for optimum performance in the context of controlling cutter loading and depth-of-cut without generating an excessive amount of torque-on-bit should the weight-on-bit be increased to a level which exceeds the optimal weight-on-bit for the current rate-of-penetration of the bit.

2. State of the Art

Rotary drag bits employing polycrystalline diamond compact (PDC) cutters have been employed for several decades. PDC cutters are typically comprised of a disc-shaped diamond "table" formed on and bonded under high-pressure and high-temperature conditions to a supporting substrate such as cemented tungsten carbide (WC), although other configurations are known. Bits carrying PDC cutters, which for example, may be brazed into pockets in the bit face, pockets in blades extending from the face, or mounted to studs inserted into the bit body, have proven very effective in achieving high rates of penetration (ROP) in drilling subterranean formations exhibiting low to medium compressive strengths. Recent improvements in the design of hydraulic flow regimes about the face of bits, cutter design, and drilling fluid formulation have reduced prior, notable tendencies of such bits to "ball" by increasing the volume of formation material which may be cut before exceeding the ability of the bit and its associated drilling fluid flow to clear the formation cuttings from the bit face.

Even in view of such improvements, however, PDC cutters still suffer from what might simply be termed "overloading" even at low weight-on-bit (WOB) applied to the drill string to which the bit carrying such cutters is mounted, especially if aggressive cutting structures are employed. The relationship of torque to WOB may be employed as an indicator of aggressivity for cutters, so the higher the torque to WOB ratio, the more aggressive the cutter. This problem is particularly significant in low compressive strength formations where an unduly great depth of cut (DOC) may be achieved at extremely low WOB. The problem may also be aggravated by drill string bounce, wherein the elasticity of the drill string may cause erratic application of WOB to the drill bit, with consequent overloading. Moreover, operating PDC cutters at an excessively high DOC may generate more formation cuttings than can be consistently cleared from the bit face and back up the bore hole via the junk slots on the face of the bit by even the aforementioned improved, state-of-the-art bit hydraulics, leading to the aforementioned bit balling phenomenon.

Another, separate problem involves drilling from a zone or stratum of higher formation compressive strength to a "softer" zone of lower strength. As the bit drills into the softer formation without changing the applied WOB (or before the WOB can be changed by the directional driller), the penetration of the PDC cutters, and thus the resulting torque on the bit (TOB), increase almost instantaneously and by a substantial magnitude. The abruptly higher torque, in turn, may cause damage to the cutters and/or the bit body itself. In directional drilling, such a change causes the tool face orientation of the directional (measuring-while-drilling, or MWD, or a steering tool) assembly to fluctuate, making it more difficult for the directional driller to follow the planned directional path for the bit. Thus, it may be necessary for the directional driller to back off the bit from the bottom of the borehole to reset or reorient the tool face. In addition, a downhole motor, such as drilling fluid-driven Moineau-type motors commonly employed in directional drilling operations in combination with a steerable bottom-hole assembly, may completely stall under a sudden torque increase. That is, the bit may stop rotating thereby stopping the drilling operation and again necessitating backing off the bit from the borehole bottom to re-establish drilling fluid flow and motor output. Such interruptions in the drilling of a well can be time consuming and quite costly.

Numerous attempts using varying approaches have been made over the years to protect the integrity of diamond cutters and their mounting structures and to limit cutter penetration into a formation being drilled. For example, from a period even before the advent of commercial use of PDC cutters, U.S. Pat. No. 3,709,308 discloses the use of trailing, round natural diamonds on the bit body to limit the penetration of cubic diamonds employed to cut a formation. U.S. Pat. No. 4,351,401 discloses the use of surface set natural diamonds at or near the gage of the bit as penetration limiters to control the depth-of-cut of PDC cutters on the bit face. The following other patents disclose the use of a variety of structures immediately trailing PDC cutters (with respect to the intended direction of bit rotation) to protect the cutters or their mounting structures: U.S. Pat. Nos. 4,889,017; 4,991,670; 5,244,039 and 5,303,785. U.S. Pat. No. 5,314,033 discloses, inter alia, the use of cooperating positive and negative or neutral backrake cutters to limit penetration of the positive rake cutters into the formation. Another approach to limiting cutting element penetration is to employ structures or features on the bit body rotationally preceding (rather than trailing) PDC cutters, as disclosed in U.S. Pat. Nos. 3,153,458; 4,554,986; 5,199,511 and 5,595,252.

In another context, that of so-called "anti-whirl" drilling structures, it has been asserted in U.S. Pat. No. 5,402,856 to one of the inventors herein that a bearing surface aligned with a resultant radial force generated by an anti-whirl underreamer should be sized so that force per area applied to the borehole sidewall will not exceed the compressive strength of the formation being underreamed. See also U.S. Pat. Nos. 4,982,802; 5,010,789; 5,042,596; 5,111,892 and 5,131,478.

While some of the foregoing patents recognize the desirability to limit cutter penetration, or DOC, or otherwise limit forces applied to a borehole surface, the disclosed approaches are somewhat generalized in nature and fail to accommodate or implement an engineered approach to achieving a target ROP in combination with more stable, predictable bit performance. Furthermore, the disclosed approaches do not provide a bit or method of drilling which is generally tolerant to being axially loaded with an amount of weight-on-bit over and in excess what would be optimum for the current rate-of-penetration for the particular formation being drilled and which would not generate high amounts of potentially bit-stopping or bit-damaging torque-on-bit should the bit nonetheless be subjected to such excessive amounts of weight-on-bit.

BRIEF SUMMARY OF THE INVENTION

The present invention addresses the foregoing needs by providing a well-reasoned, easily implementable bit design particularly suitable for PDC cutter-bearing drag bits, which bit design may be tailored to specific formation compressive strengths or strength ranges to provide DOC control in terms of both maximum DOC and limitation of DOC variability. As a result, continuously achievable ROP may be optimized and torque controlled even under high WOB, while destructive loading of the PDC cutters is largely prevented.

The bit design of the present invention employs depth of cut control (DOCC) features which reduce, or limit, the extent in which PDC cutters, or other types of cutters or cutting elements, are exposed on the bit face, on bladed structures, or as otherwise positioned on the bit. The DOCC features of the present invention provide substantial area on which the bit may ride while the PDC cutters of the bit are engaged with the formation to their design DOC, which may be defined as the distance the PDC cutters are effectively exposed below the DOCC features. Stated another way, the cutter standoff is substantially controlled by the effective amount of exposure of the cutters above the surface, or surfaces, surrounding each cutter. Thus, by constructing the bit so as to limit the exposure of at least some of the cutters on the bit, such limited exposure of the cutters in combination with the bit providing ample surface area to serve as a "bearing surface" in which the bit rides as the cutters engage the formation at their respective design DOC enables a relatively greater DOC (and thus ROP for a given bit rotational speed) than with a conventional bit design without the adverse consequences usually attendant thereto. Therefore the DOCC features of the present invention preclude a greater DOC than that designed for by distributing the load attributable to WOB over a sufficient surface area on the bit face, blades or other bit body structure contacting the formation face at the borehole bottom so that the compressive strength of the formation will not be exceeded by the DOCC features. As a result, the bit does not substantially indent, or fail, the formation rock.

Stated another way, the present invention limits the unit volume of formation material (rock) removed per bit rotation to prevent the bit from over-cutting the formation material and balling the bit or damaging the cutters. If the bit is employed in a directional drilling operation, tool face loss or motor stalling is also avoided.

In one embodiment, a rotary drag bit preferably includes a plurality of circumferentially spaced blade structures extending along the leading end or formation engaging portion of the bit generally from the cone region approximate the longitudinal axis, or centerline, of the bit, upwardly to the gage region, or maximum drill diameter of bit. The bit further includes a plurality of superabrasive cutting elements, or cutters such as PDC cutters, preferably disposed on radially outward facing surfaces of preferably each of the blade structures. In accordance with the DOCC aspect of the present invention, each cutter positioned in at least the cone region of the bit, e.g., those cutters which are most radially proximate the longitudinal centerline and thus are generally positioned radially inward of a shoulder portion of the bit, are disposed in their respective blade structures in such a manner that each of such cutters is exposed only to a limited extent above the radially outwardly facing surface of the blade structures in which the cutters are associatively disposed. That is, each of such cutters exhibit a limited amount of exposure generally perpendicular to the selected portion of the formation-facing surface in which the superabrasive cutter is secured to control the effective depth-of-cut of at least one superabrasive cutter into a formation when the bit is rotatingly engaging a formation such as during drilling. By so limiting the amount of exposure of such cutters by, for example, the cutters being secured within and substantially encompassed by cutter-receiving pockets, or cavities, the DOC of such cutters into the formation is effectively and individually controlled. Thus, regardless of the amount of WOB placed, or applied, on the bit, even if the WOB exceeds what would be considered an optimum amount for the hardness of the formation being drilled and the ROP in which the drill bit is currently providing, the resulting torque, or TOB, will be controlled or modulated. Thus, because such cutters have a reduced amount of exposure above the respective formation-facing surface in which it is installed, especially as compared to prior art cutter installation arrangements, the resultant TOB generated by the bit will be limited to a maximum, acceptable value. This beneficial result is attributable to the DOCC features, or characteristic, of the present invention effectively preventing at least a sufficient number of the total number of cutters from over-engaging the formation and potentially causing the rotation of the bit to slow or stall due to an unacceptably high amount of torque being generated. Furthermore, the DOCC features of the present invention are essentially unaffected by excessive amounts of WOB, as there will preferably be a sufficient amount or size of bearing surface area devoid of cutters on at least the leading end of the bit in which the bit may "ride" upon the formation to inhibit or prevent a torque-induced bit stall from occurring.

Optionally, bits employing the DOCC aspects of the present invention may have reduced exposure cutters positioned radially more distant than those cutters proximate to the longitudinal centerline of the bit such as in the cone region. To elaborate, cutters having reduced exposure may be positioned in other regions of a drill bit embodying the DOCC aspects of the present invention. For example, reduced exposure cutters positioned on the comparatively more radially distant nose, shoulder, flank, and gage portions of a drill bit will exhibit a limited amount of cutter exposure generally perpendicular to the selected portion of the radially outwardly facing surface to which each of the reduced exposure cutters are respectively secured. Thus, the surfaces carrying and proximately surrounding each of the additional reduced exposure cutters will be available to contribute to the total combined bearing surface area on which the bit will be able to ride upon the formation as the respective maximum depth-of-cut for each additional reduced exposure cutter is achieved depending upon the instant WOB and the hardness of the formation being drilled.

By providing DOCC features having a cumulative surface area sufficient to support a given WOB on a given rock formation preferably without substantial indentation or failure of same, WOB may be dramatically increased, if desired, over that usable in drilling with conventional bits without the PDC cutters experiencing any additional effective WOB after the DOCC features are in full contact with the formation. Thus, the PDC cutters are protected from damage and, equally significant, the PDC cutters are prevented from engaging the formation to a greater depth of cut and consequently generating excessive torque which might stall a motor or cause loss of tool face orientation.

The ability to dramatically increase WOB without adversely affecting the PDC cutters also permits the use of WOB substantially above and beyond the magnitude applicable without the adverse effects associated with conventional bits to maintain the bit in contact with the formation, reduce vibration and enhance the consistency and depth of cutter engagement with the formation. In addition, drill string vibration as well as dynamic axial effects, commonly termed "bounce," of the drill string under applied torque and WOB may be damped so as to maintain the design DOC for the PDC cutters. Again, in the context of directional drilling, this capability ensures maintenance of tool face and stall-free operation of an associated downhole motor driving the bit.

It is specifically contemplated that the DOCC features according to the present invention may be applied to coring bits as well as full bore drill bits. As used herein, the term "bit" encompasses core bits and other special purpose bits. Such usage may be, by way of example only, particularly beneficial when coring from a floating drilling rig, or platform, where WOB is difficult to control because of surface water wave-action-induced rig heave. When using the present invention, a WOB in excess of that normally required for coring may be applied to the drill string to keep the core bit on bottom and maintain core integrity and orientation.

It is also specifically contemplated that the DOCC attributes of the present invention have particular utility in controlling, and specifically reducing, torque required to rotate rotary drag bits as WOB is increased. While relative torque may be reduced in comparison to that required by conventional bits for a given WOB by employing the DOCC features at any radius or radii range from the bit centerline, variation in placement of DOCC features with respect to the bit centerline may be a useful technique for further limiting torque since the axial loading on the bit from applied WOB is more heavily emphasized toward the centerline and the frictional component of the torque is related to such axial loading. Accordingly, the present invention optionally includes providing a bit in which the extent of exposure of the cutters vary with respect to the cutters respective positions on the face of the bit. As an example, one or more of the cutters positioned in the cone, or the region of the bit proximate the centerline of the bit, are exposed to a first extent, or amount, to provide a first DOC and one or more cutters positioned in the more radially distant nose and shoulder regions of the bit are exposed at a second extent, or amount, to provide a second DOC. Thus, a specifically engineered DOC profile may be incorporated into the design of a bit embodying the present invention to customize, or tailor, the bit's operational characteristics in order to achieve a maximum ROP while minimizing and/or modulating the TOB at the current WOB, even if the WOB is higher than what would otherwise be desired for the ROP and the specific hardness of the formation then being drilled.

Furthermore, bits embodying the present invention may include blade structures in which the extent of exposure of each cutter positioned on each blade structure has a particular and optionally individually unique DOC, as well as individually selected and possibly unique effective backrake angles, thus resulting in each blade of the bit having a preselected DOC cross-sectional profile as taken longitudinally parallel to the centerline of the bit and taken radially to the outermost gage portion of each blade. Moreover, a bit incorporating the DOCC features of the present invention need not have cutters installed on, or carried by, blade structures, as cutters having a limited amount of exposure perpendicular to the exterior of the bit in which each cutter is disposed may be incorporated on regions of bits in which no blade structures are present. That is, bits incorporating the present invention may be completely devoid of blade structures entirely, such as, for example, a coring bit.

A method of constructing a drill bit in accordance with the present invention is additionally disclosed herein. The method includes providing at least a portion of the drill bit with at least one cutting element-accommodating pocket, or cavity, on a surface which will ultimately face and engage a formation upon the drill bit being placed in operation. The method of constructing a bit for drilling subterranean formations includes disposing within at least one cutter-receiving pocket a cutter exhibiting a limited amount of exposure perpendicular to the formation-facing surface proximate the cutter upon the cutter being secured therein. Optionally, the formation-facing surface may be built up by a hard facing, a weld, a weldment, or other material being disposed upon the surface surrounding the cutter so as to provide a bearing surface of a sufficient size while also limiting the amount of cutter exposure within a preselected range to effectively control the depth of cut that the cutter may achieve upon a certain WOB being exceeded and/or upon a formation of a particular compressive strength being encountered.

A yet further option is to provide wear knots, or structures, formed of a suitable material which extend outwardly and generally perpendicularly from the face of the bit in general proximity of at least one or more of the reduced exposure cutters. Such wear knots may be positioned rotationally behind, or trailing, each provided reduced exposure cutter so as to augment the DOCC aspects provided by the bearing surface respectively carrying and proximately surrounding a significant portion of each reduced exposure cutter. Thus, the optional wear knots, or wear bosses, provide a bearing surface area in which the drill bit may ride on the formation upon the maximum DOC of that cutter being obtained for the present formation hardness and then current WOB. Such wear knots, or bosses, may comprise hard facing material, structure provided when casting or molding the bit body or, in the case of steel-bodied bits, may comprise weldments, structures secured to the bit body by methods known within the art of subterranean drill bit construction, or by surface welds in the shape of one or more weld-beads or other configurations or geometries.

A method of drilling a subterranean formation is further disclosed. The method for drilling includes engaging a formation with at least one cutter and preferably a plurality of cutters in which one or more of the cutters each exhibit a limited amount of exposure perpendicular to a surface in which each cutter is secured. In one embodiment, several of the plurality of limited exposure cutters are positioned on a formation-facing surface of at least one portion, or region, of at least one blade structure to render a cutter spacing and cutter exposure profile for that blade and preferably for a plurality of blades that will enable the bit to engage the formation within a wide range of WOB without generating an excessive amount of TOB, even at elevated WOBs, for the instant ROP in which the bit is providing. The method further includes an alternative embodiment in which the drilling is conducted with primarily only the reduced exposure cutters engaging a relatively hard formation within a selected range of WOB and upon a softer formation being encountered and/or an increased amount of WOB being applied, at least one bearing surface surrounding at least one reduced, or limited, exposure cutter, and preferably a plurality of sufficiently sized bearing surfaces respectively surrounding a plurality of reduced exposure cutters, contacts the formation and thus limits the DOC of each reduced, or limited, exposure cutter while allowing the bit to ride on the bearing surface, or bearing surfaces, against the formation regardless of the WOB being applied to the bit and without generating an unacceptably high, potentially bit damaging TOB for the current ROP.

DETAILED DESCRIPTION OF THE INVENTION

Figure 1:
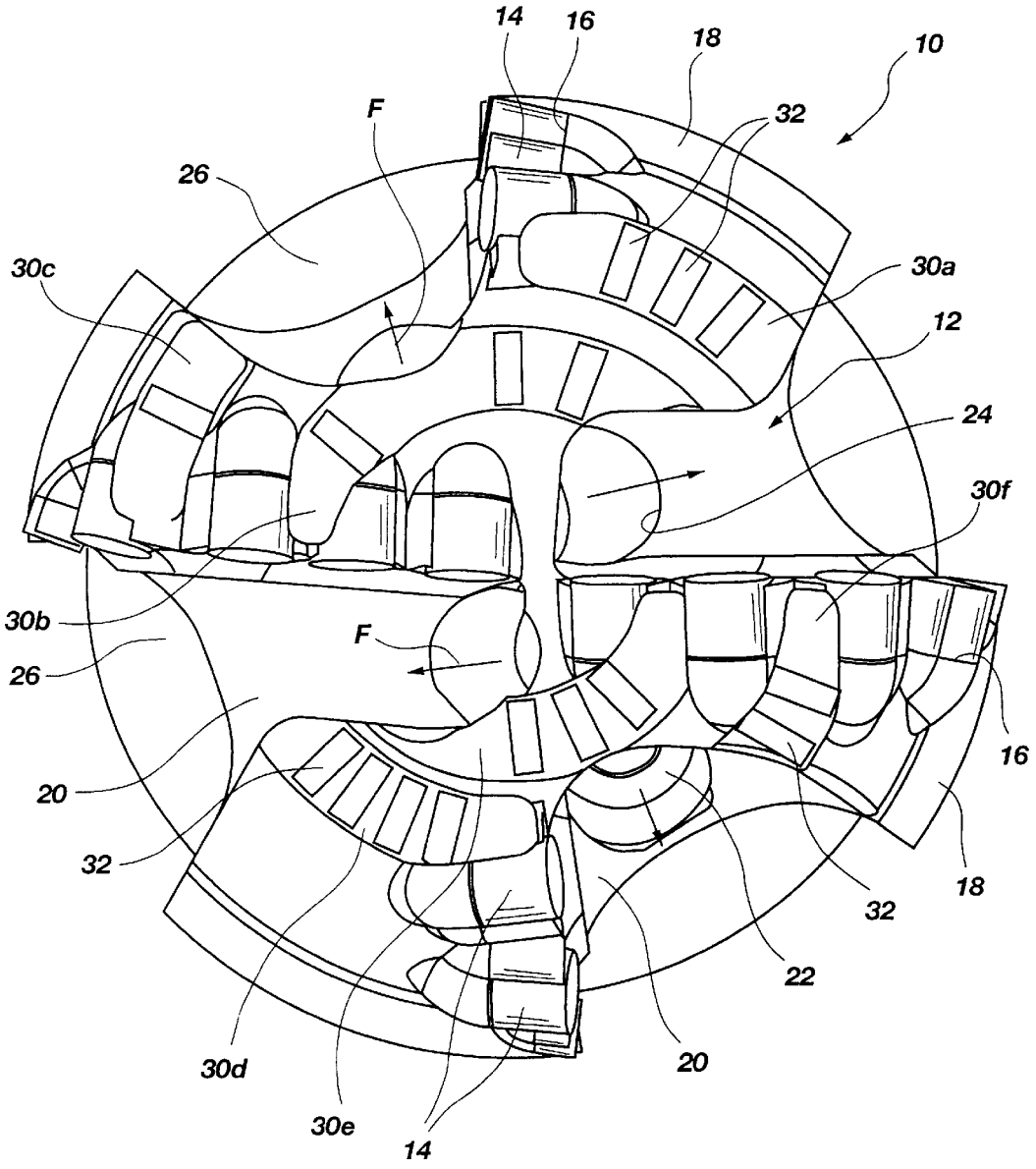
FIG. 1 is a bottom elevation looking upward at the face of one embodiment of a drill bit including the DOCC features according to the invention.

FIG. 1 of the drawings depicts a rotary drag bit 10 looking upwardly at its face or leading end 12 as if the viewer were positioned at the bottom of a borehole. Bit 10 includes a plurality of PDC cutters 14 bonded by their substrates (diamond tables and substrates not shown separately for clarity), as by brazing, into pockets 16 in blades 18 extending above the face 12, as is known in the art with respect to the fabrication of so-called "matrix" type bits. Such bits include a mass of metal powder, such as tungsten carbide, infiltrated with a molten, subsequently hardenable binder, such as a copper-based alloy. It should be understood, however, that the present invention is not limited to matrix-type bits, and that steel body bits and bits of other manufacture may also be configured according to the present invention.

Figure 2:
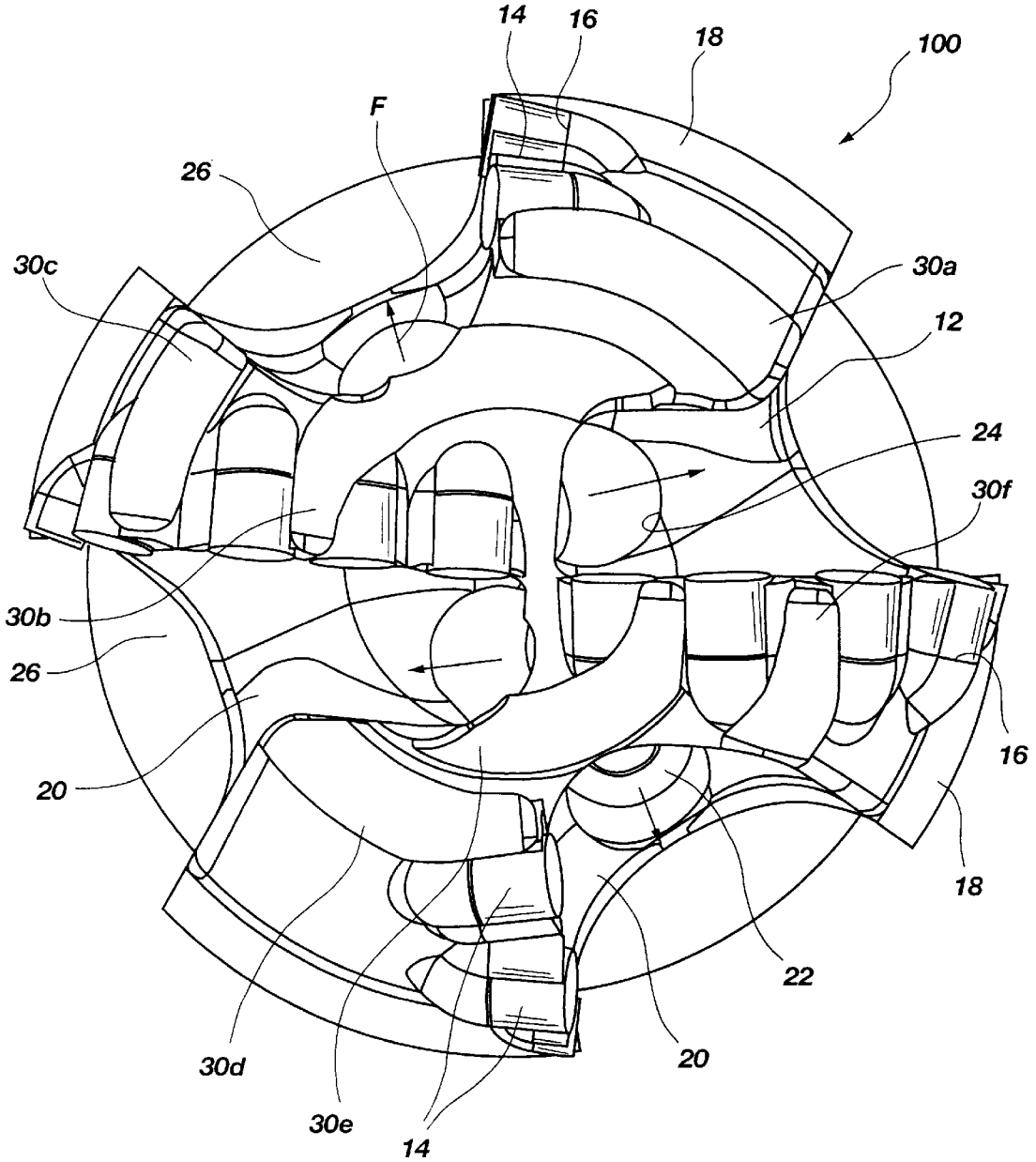
FIG. 2 is a bottom elevation looking upward at the face of another embodiment of a drill bit including the DOCC features according to the invention.
Figure 2A:
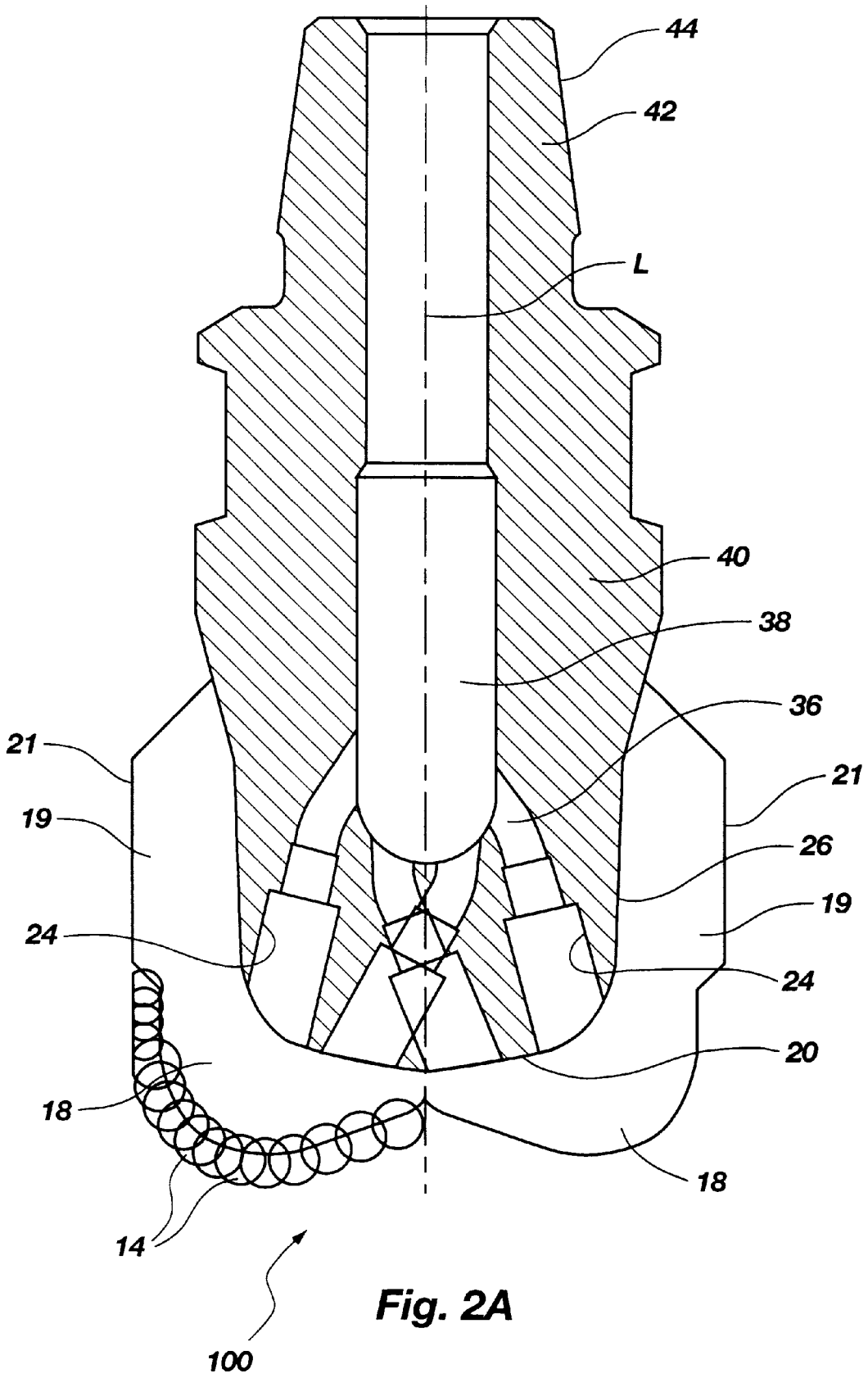
FIG. 2A is a side sectional elevation of the profile of the bit of FIG. 2.

Fluid courses 20 lie between blades 18 and are provided with drilling fluid by nozzles 22 secured in nozzle orifices 24, orifices 24 being at the end of passages leading from a plenum extending into the bit body from a tubular shank at the upper, or trailing, end of the bit (see FIG. 2A in conjunction with the accompanying text for a description of these features). Fluid courses 20 extend to junk slots 26 extending upwardly along the side of bit 10 between blades 18. Gage pads 19 comprise longitudinally upward extensions of blades 18 and may have wear-resistant inserts or coatings on radially outer surfaces 21 thereof as known in the art. Formation cuttings are swept away from PDC cutters 14 by drilling fluid F emanating from nozzle orifices 24 which moves generally radially outwardly through fluid courses 20 and then upwardly through junk slots 26 to an annulus between the drill string from which the bit 10 is suspended and on to the surface.

A plurality of the DOCC features, each comprising an arcuate bearing segment 30*a* through 30*f*, reside on, and in some instances bridge between, blades 18. Specifically, bearing segments 30*b* and 30*e* each reside partially on an adjacent blade 18 and extend therebetween. The arcuate bearing segments 30*a* through 30*f*, each of which lies along substantially the same radius from the bit centerline as a PDC cutter 14 rotationally trailing that bearing segment 30, together provide sufficient surface area to withstand the axial or longitudinal WOB without exceeding the compressive strength of the formation being drilled, so that the rock does not indent or fail and the penetration of PDC cutters 14 into the rock is substantially controlled. As can be seen in FIG. 1, wear-resistant elements or inserts 32, in the form of tungsten carbide bricks or discs, diamond grit, diamond film, natural or synthetic diamond (PDC or TSP), or cubic boron nitride, may be added to the exterior bearing surfaces of bearing segments 30 to reduce the abrasive wear thereof by contact with the formation under WOB as the bit 10 rotates under applied torque. In lieu of inserts, the bearing surfaces may be comprised of, or completely covered with, a wear-resistant material. The significance of wear characteristics of the DOCC features will be explained in more detail below.

FIGS. 2 and 2A depict another embodiment of a rotary drill bit 100 according to the present invention, and features and elements in FIGS. 2 and 2A corresponding to those identified with respect to bit 10 of FIG. 1 are identified with the same reference numerals. FIG. 2 depicts a rotary drill bit 100 looking upwardly at its face 12 as if the viewer were positioned at the bottom of a borehole. Bit 100 also includes a plurality of PDC cutters 14 bonded by their substrates (diamond tables and substrates not shown separately for clarity), as by brazing, into pockets 16 in blades 18 extending above the face 12 of bit 100.

Fluid courses 20 lie between blades 18 and are provided with drilling fluid F by nozzles 22 secured in nozzle orifices 24, orifices 24 being at the end of passages 36 leading from a plenum 38 extending into bit body 40 from a tubular shank 42 threaded (not shown) on its exterior surface 44 as known in the art at the upper end of the bit (see FIG. 2A). Fluid courses 20 extend to junk slots 26 extending upwardly along the side of bit 10 between blades 18. Gage pads 19 comprise longitudinally upward extensions of blades 18 and may have wear-resistant inserts or coatings on radially outer surfaces 21 thereof as known in the art.

A plurality of the DOCC features, each comprising an arcuate bearing segment 30*a* through 30*f*, reside on, and in some instances bridge between, blades 18. Specifically, bearing 30*b* and 30*e* each reside partially on an adjacent blade 18 and extend therebetween. The arcuate bearing segments 30*a* through 30*f*, each of which lies substantially along the same radius from the bit centerline as a PDC cutter 14 rotationally trailing that bearing segment 30, together provide sufficient surface area to withstand the axial or longitudinal WOB without exceeding the compressive strength of the formation being drilled, so that the rock does not unduly indent or fail and the penetration of PDC cutters 14 into the rock is substantially controlled.

By way of example only, the total DOCC features surface area for an 8.5 inch diameter bit generally configured as shown in FIGS. 1 and 2 may be about 12 square inches. If, for example, the unconfined compressive strength of a relatively soft formation to be drilled by either bit 10 or 100 is 2,000 pounds per square inch (psi), then at least about 24,000 lbs. WOB may be applied without failing or indenting the formation. Such WOB is far in excess of the WOB which may normally be applied to a bit in such formations (for example, as little as 1,000 to 3,000 lbs., up to about 5,000 lbs.) without incurring bit balling from excessive DOC and the consequent cuttings volume which overwhelms the bit's hydraulic ability to clear them. In harder formations, with, for example, 20,000 to 40,000 psi compressive strengths, the total DOCC features surface area may be significantly reduced while still accommodating substantial WOB applied to keep the bit firmly on the borehole bottom. When older, less sophisticated, drill rigs are employed or during directional drilling, both of which render it difficult to control WOB with any substantial precision, the ability to overload WOB without adverse consequences further distinguishes the superior performance of bits embodying the present invention. It should be noted at this juncture that the use of an unconfined compressive strength of formation rock provides a significant margin for calculation of the required bearing area of the DOCC features for a bit, as the in situ, confined, compressive strength of a subterranean formation being drilled is substantially higher. Thus, if desired, confined compressive strength values of selected formations may be employed in designing the total DOCC features as well as the total bearing area of a bit to yield a smaller required area, but which still advisedly provides for an adequate "margin" of excess bearing area in recognition of variations in continued compressive strengths of the formation to preclude substantial indentation and failure of the formation downhole.

Figure 13A:
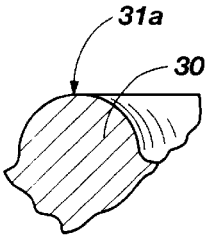
FIGS. 13A, 13B and 13C are transverse sections of various cross-sectional configurations for the DOCC features according to the invention.
Figure 13B:
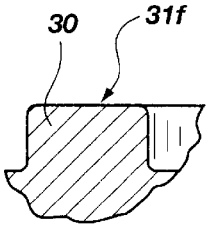
Figure 13C:
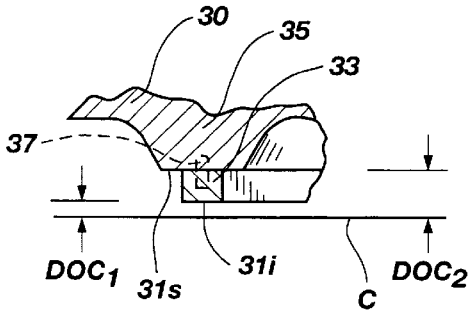

While bit 100 is notably similar to bit 10, the viewer will recognize and appreciate that wear inserts 32 are omitted from bearing segments on bit 100, such an arrangement being suitable for less abrasive formations where wear is of lesser concern and the tungsten carbide of the bit matrix (or applied hard facing in the case of a steel body bit) is sufficient to resist abrasive wear for a desired life of the bit. As shown in FIG. 13A, the DOCC features (bearing segments 30) of either bit 10 or bit 100, or of any bit according to the invention, may be of arcuate cross-section, taken transverse to the arc followed as the bit rotates, to provide an arcuate bearing surface 31*a* mimicking the cutting edge arc of an unworn, associated PDC cutter following a DOCC feature. Alternatively, as shown in FIG. 13B, a DOCC feature (bearing segment 30) may exhibit a flat bearing surface 31*f* to the formation, or may be otherwise configured. It is also contemplated, as shown in FIG. 13C, that a DOCC feature (bearing segment 30) may be crosssectionally configured and comprised of a material so as to intentionally and relatively quickly (in comparison to the wear rate of a PDC cutter) wear from a smaller initial bearing surface 31*i* providing a relatively small $DOC_1$ with respect to the point or line of contact C with the formation traveled by the cutting edge of a trailing, associated PDC cutter while drilling a first, hard formation interval to a larger, secondary bearing surface 31*s* which also provides a much smaller $DOC_2$ for a second, lower, much softer (and lower compressive strength) formation interval. Alternatively, the head 33 of the DOCC structure (bearing segment 30) may be made controllably shearable from the base 35 (as with frangible connections like a shear pin, one shear pin 37 shown in broken lines).

For reference purposes, bits 10 and 100 as illustrated may be said to be symmetrical or concentric about their centerlines or longitudinal axes L, although this is not necessarily a requirement of the invention.

Both bits 10 and 100 are unconventional in comparison to state of the art bits in that PDC cutters 14 on bits 10 and 100 are disposed at far lesser backrakes, in the range of, for example, 7° to 15° with respect to the intended direction of rotation generally perpendicular to the surface of the formation being engaged. In comparison, many conventional bits are equipped with cutters at a 30° backrake, and a 20° backrake is regarded as somewhat "aggressive" in the art. The presence of the DOCC feature permits the use of substantially more aggressive backrakes, as the DOCC features preclude the aggressively raked PDC cutters from penetrating the formation to too great a depth, as would be the case in a bit without the DOCC features.

In the cases of both bit 10 and bit 100, the rotationally leading DOCC features (bearing segments 30) are configured and placed to substantially exactly match the pattern drilled in the bottom of the borehole when drilling at an ROP of 100 feet per hour (fph) at 120 rotations per minute (rpm) of the bit. This results in a DOC of about 0.166 inch per revolution. Due to the presence of the DOCC features (bearing segments 30), after sufficient WOB has been applied to drill 100 fph, any additional WOB is transferred from the body 40 of the bit 10 or 100 through the DOCC features to the formation. Thus, the cutters 14 are not exposed to any substantial additional weight, unless and until a WOB sufficient to fail the formation being drilled would be applied, which application may be substantially controlled by the driller, since the DOCC features may be engineered to provide a large margin of error with respect to any given sequence of formations which might be encountered when drilling an interval.

As a further consequence of the present invention, the DOCC features would, as noted above, preclude cutters 14 from excessively penetrating or "gouging" the formation, a major advantage when drilling with a downhole motor where it is often difficult to control WOB and WOB inducing such excessive penetration can result in the motor stalling, with consequent loss of tool face and possible damage to motor components as well as to the bit itself. While the addition of WOB beyond that required to achieve the desired ROP will require additional torque to rotate the bit due to frictional resistance to rotation of the DOCC features over the formation, such additional torque is a lesser component of the overall torque.

Figure 3:
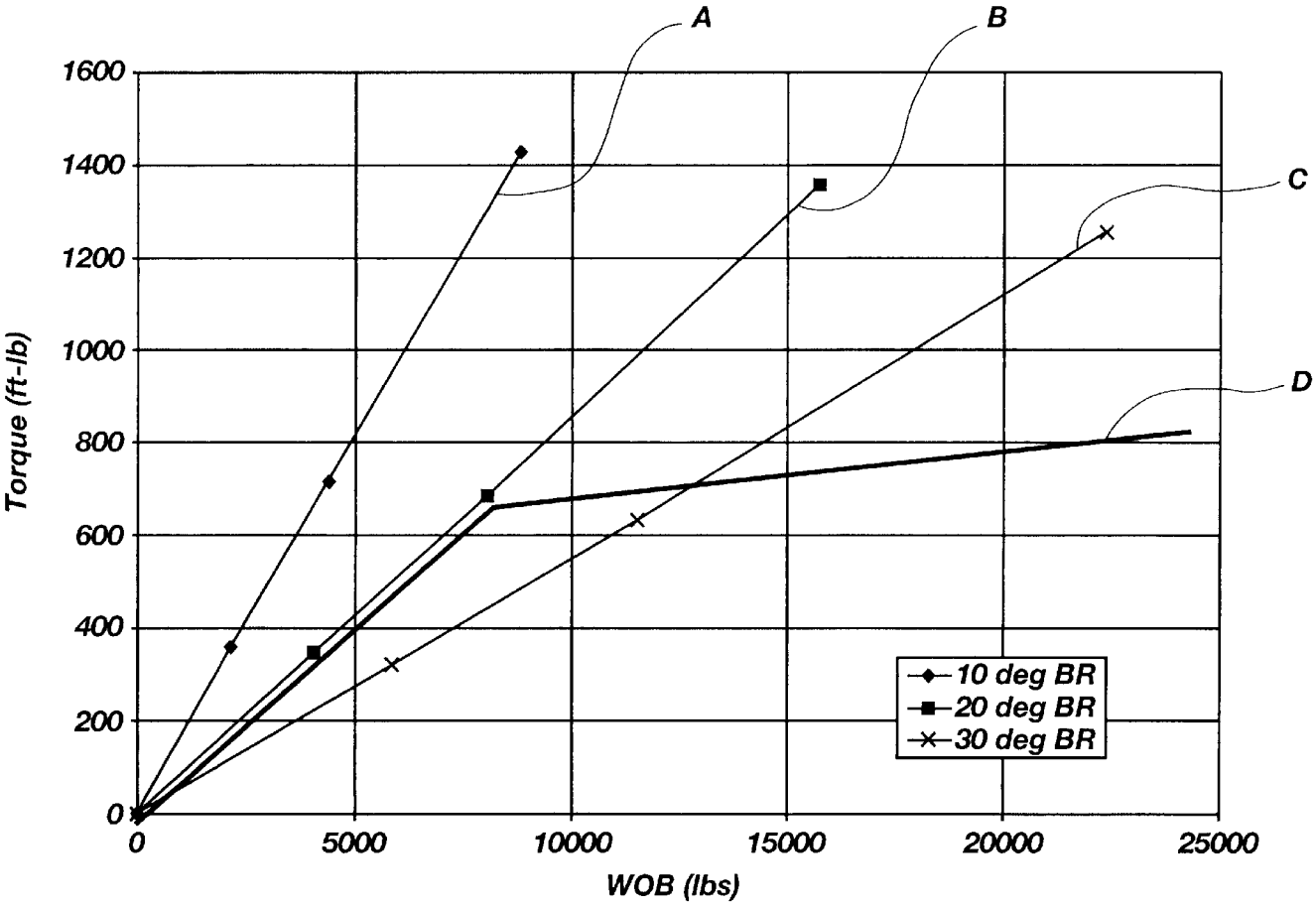
FIG. 3 is a graph depicting mathematically predicted torque versus WOB for conventional bit designs employing cutters at different backrakes versus a similar bit according to the present invention.

The benefit of DOCC features in controlling torque can readily be appreciated by a review of FIG. 3 of the drawings, which is a mathematical model of performance of a 3 ¾ inch diameter, four-bladed, Hughes Christensen R324XL PDC bit showing various torque versus WOB curves for varying cutter backrakes in drilling Mancos shale. Curve A represents the bit with a 10° cutter backrake, curve B, the bit with a 20° cutter backrake, curve C, the bit with a 30° cutter backrake, and curve D, the bit using cutters disposed at a 20° backrake and including the DOCC features according to the present invention. The model assumes a bit design according to the invention for an ROP of 50 fph at 100 rpm, which provides 0.1 inch per revolution penetration of a formation being drilled. As can readily be seen, regardless of cutter backrake, curves A through C clearly indicate that, absent the DOCC features according to the present invention, required torque on the bit continues to increase continuously and substantially linearly with applied WOB, regardless of how much WOB is applied. On the other hand, curve D indicates that, after WOB approaches about 8,000 lbs. on the bit including the DOCC features, the torque curve flattens significantly and increases in a substantially linear manner only slightly from about 670 ft-lb. to just over 800 ft-lb. even as WOB approaches 25,000 lbs. As noted above, this relatively small increase in the torque after the DOCC features engage the formation is frictionally related, and is also somewhat predictable. As graphically depicted in FIG. 3, this additional torque load increases substantially linearly as a function of WOB times the coefficient of friction between the bit and the formation.

Figure 4:
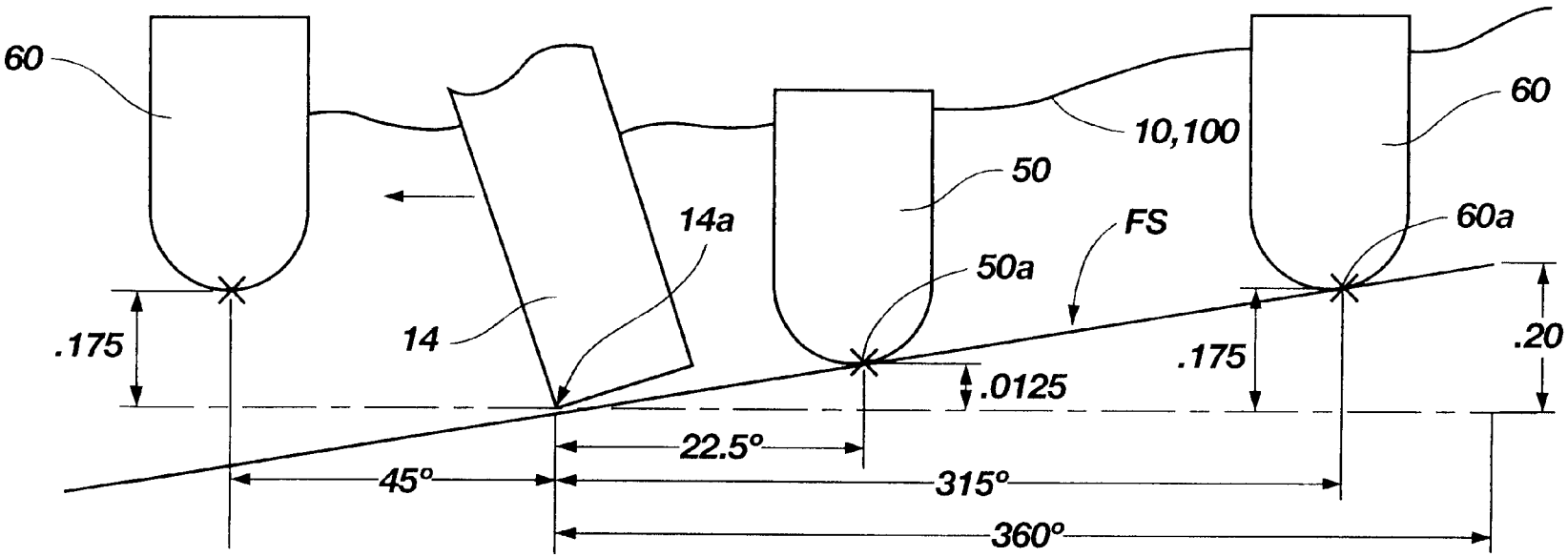
FIG. 4 is a schematic side elevation, not to scale, comparing prior art placement of a depth-of-cut limiting structure closely behind a cutter at the same radius, taken along a 360° rotational path, versus placement according to the present invention preceding the cutter and at the same radius.

Referring now to FIG. 4 (which is not to scale) of the drawings, a further appreciation of the operation and benefits of the DOCC features according to the present invention may be obtained. Assuming a bit designed for an ROP of 120 fph at 120 rpm, this requires an average DOC of 0.20 inch. The DOCC features or DOC limiters would thus be designed to first contact the subterranean formation surface FS to provide a 0.20 inch DOC. It is assumed for the purposes of FIG. 4 that DOCC features or DOC limiters are sized so that compressive strength of the formation being drilled is not exceeded under applied WOB. As noted previously, the compressive strength of concern would typically be the in situ compressive strength of the formation rock resident in the formation being drilled (plus some safety factor), rather than unconfined compressive strength of a rock sample. In FIG. 4, an exemplary PDC cutter 14 is shown, for convenience, moving linearly right to left on the page. One complete revolution of the bit 10 or 100 on which PDC cutter 14 is mounted has been "unscrolled" and laid out flat in FIG. 4. Thus, as shown, PDC cutter 14 has progressed downwardly (i.e., along the longitudinal axis of the bit 10 or 100 on which it is mounted) 0.20 inch in 360° of rotation of the bit 10 or 100. As shown in FIG. 4, a structure or element to be used as a DOC limiter 50 is located conventionally, closely rotationally "behind" PDC cutter 14, as only 22.5° behind PDC cutter 14, the outermost tip 50*a* must be recessed upwardly 0.0125 inch (0.20 inch DOC×22.5°/360°) from the outermost tip 14*a* of PDC cutter 14 to achieve an initial 0.20 inch DOC. However, when DOC limiter 50 wears during drilling, for example by a mere 0.010 inch relative to the tip 14*a* of PDC cutter 14, the vertical offset distance between the tip 50*a* of DOC limiter 50 and tip 14*a* of PDC cutter 14 is increased to 0.0225 inch. Thus, DOC will be substantially increased, in fact, almost doubled, to 0.36 inch. Potential ROP would consequently equal 216 fph due to the increase in vertical standoff provided PDC cutter 14 by worn DOC limiter 50, but the DOC increase may damage PDC cutter 14 or ball the bit 10 or 100 by generating a volume of formation cuttings which overwhelms the bit's ability to clear them hydraulically. Similarly, if PDC cutter tip 14*a* wore at a relatively faster rate than DOC limiter 50 by, for example, 0.010 inch, the vertical offset distance is decreased to 0.0025 inch, DOC is reduced to 0.04 inch and ROP, to 24 fph. Thus, excessive wear or vertical misplacement of either PDC cutter 14 or DOC limiter 50 to the other may result in a wide range of possible ROPs for a given rotational speed. On the other hand, if an exemplary DOCC feature 60 is placed, according to the present invention, 45° rotationally in front of (or 315° rotationally behind) PDC cutter tip 14*a,* the outermost tip 60*a* would initially be recessed upwardly 0.175 inch (0.20 inch DOC×315°/360°) relative to PDC cutter tip 14*a* to provide the initial 0.20 inch DOC. FIG. 4 shows the same DOCC feature 60 twice, both rotationally in front of and behind PDC cutter 14, for clarity, it being, of course, understood that the path of PDC cutter 14 is circular throughout a 360° arc in accordance with rotation of bit 10 or 100. When DOCC feature 60 wears 0.010 inch relative to PDC cutter tip 14*a,* the vertical offset distance between tip 60*a* of DOCC feature 60 and tip 14*a* of PDC cutter 14 is only increased from 0.175 inch to 0.185 inch. However, due to the placement of DOCC feature 60 relative to PDC cutter 14, DOC will be only slightly increased to about 0.211 inch. As a consequence, ROP would only increase to about 127 fph. Likewise, if PDC cutter 14 wears 0.010 inch relative to DOCC feature 60, vertical offset of DOCC feature 60 is only reduced to 0.165 inch and DOC is only reduced to about 0.189 inch, with an attendant ROP of about 113 fph. Thus, it can readily be seen how rotational placement of a DOCC feature can significantly affect ROP as the limiter or the cutter wears with respect to the other, or if one such component has been misplaced or incorrectly sized to protrude incorrectly even slightly upwardly or downwardly of its ideal, or "design," position relative to the other, associated component when the bit is fabricated. Similarly, mismatches in wear between a cutter and a cutter-trailing DOC limiter are magnified in the prior art, while being significantly reduced when DOCC features sized and placed in cutter-leading positions according to the present invention are employed. Further, if a DOC limiter trailing, rather than leading, a given cutter is employed, it will be appreciated that shock or impact loading of the cutter is more probable as, by the time the DOC limiter contacts the formation, the cutter tip will have already contacted the formation. Leading DOCC features, on the other hand, by being located in advance of a given cutter along the downward helical path the cutter travels as it cuts the formation and the bit advances along its longitudinal axis, tend to engage the formation before the cutter. The terms "leading" and "trailing" the cutter may be easily understood as being preferably respectively associated with DOCC features positions up to 180° rotationally preceding a cutter versus positions up to 180° rotationally trailing a cutter. While some portion of, for example, an elongated, arcuate leading DOCC feature according to the present invention may extend so far rotationally forward of an associated cutter so as to approach a trailing position, the substantial majority of the arcuate length of such a DOCC feature would preferably reside in a leading position. As may be appreciated by further reference to FIGS. 1 and 2, there may be a significant rotational spacing between a PDC cutter 14 and an associated bearing segment 30 of a DOCC feature, as across a fluid course 20 and its associated junk slot 26, while still rotationally leading the PDC cutter 14. More preferably, at least some portion of a DOCC feature according to the invention will lie within about 90° rotationally preceding the face of an associated cutter.

One might question why limitation of ROP would be desirable, as bits according to the present invention using DOCC features may not, in fact, drill at as great an ROP as conventional bits not so equipped. However, as noted above, by using DOCC features to achieve a predictable and substantially sustainable DOC in conjunction with a known ability of a bit's hydraulics to clear formation cuttings from the bit at a given maximum volumetric rate, a sustainable (rather than only peak) maximum ROP may be achieved without the bit balling and with reduced cutter wear and substantial elimination of cutter damage and breakage from excessive DOC, as well as impact-induced damage and breakage. Motor stalling and loss of tool face may also be eliminated. In soft or ultra-soft formations very susceptible to balling, limiting the unit volume of rock removed from the formation per unit time prevents a bit from "over cutting" the formation. In harder formations, the ability to apply additional WOB in excess of what is needed to achieve a design DOC for the bit may be used to suppress unwanted vibration normally induced by the PDC cutters and their cutting action, as well as unwanted drill string vibration in the form of bounce, manifested on the bit by an excessive DOC. In such harder formations, the DOCC features may also be characterized as "load arresters" used in conjunction with "excess" WOB to protect the PDC cutters from vibration-induced damage, the DOCC features again being sized so that the compressive strength of the formation is not exceeded. In harder formations, the ability to damp out vibrations and bounce by maintaining the bit in constant contact with the formation is highly beneficial in terms of bit stability and longevity, while in steerable applications the invention precludes loss of tool face.

Figure 5:
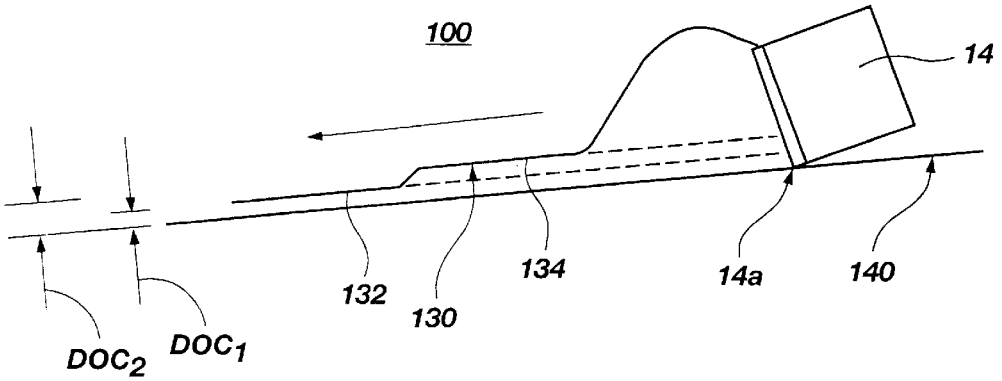
FIG. 5 is a schematic side elevation of a two-step DOCC feature and associated trailing PDC cutter.

FIG. 5 depicts one exemplary variation of a DOCC feature according to the present invention, which may be termed a "stepped" DOCC feature 130 comprising an elongated, arcuate bearing segment. Such a configuration, shown for purposes of illustration preceding a PDC cutter 14 on a bit 100 (by way of example only), includes a lower, rotationally leading first step 132 and a higher, rotationally trailing second step 134. As tip 14*a* of PDC cutter 14 follows its downward helical path generally indicated by line 140 (the path, as with FIG. 4, being unscrolled on the page), the surface area of first step 132 may be used to limit DOC in a harder formation with a greater compressive strength, the bit "riding" high on the formation with cutter 14 taking a minimal $DOC_1$ in the formation surface, shown by the lower dashed line. However, as bit 100 enters a much softer formation with a far lesser compressive strength, the surface area of first step 132 will be insufficient to prevent indentation and failure of the formation, and so first step 132 will indent the formation until the surface of second step 134 encounters the formation material, increasing DOC by cutter 14. At that point, the total surface area of first and second steps 132 and 134 (in combination with other first and second steps respectively associated with other cutters 14) will be sufficient to prevent further indentation of the formation and the deeper $DOC_2$ in the surface of the softer formation (shown by the upper dashed line) will be maintained until the bit 100 once again encounters a harder formation. When this occurs, the bit 100 will ride up on the first step 132, which will take any impact from the encounter before cutter 14 encounters the formation, and the DOC will be reduced to its previous DOC level, avoiding excessive torque and motor stalling.

Figure 6A:
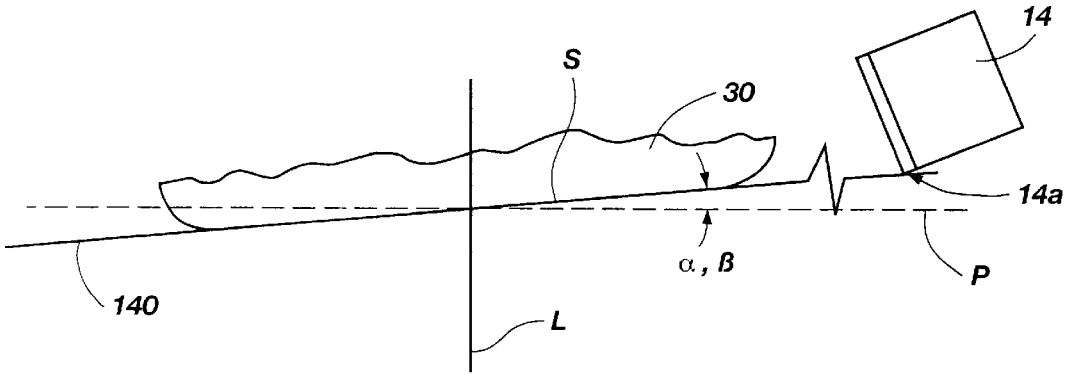
FIGS. 6A and 6B are, respectively, schematics of single-angle bearing surface and multi-angle bearing surface DOCC feature.
Figure 6B:
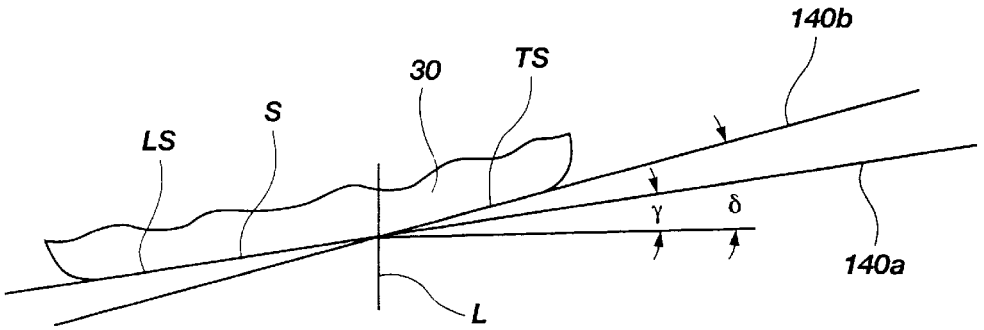

As shown in FIGS. 1 and 2, one or more DOCC features of a bit according to an invention may comprise elongated arcuate bearing segments 30 disposed at substantially the same radius about the bit longitudinal axis or centerline as a cutter preceded by that DOCC feature. In such an instance, and as depicted in FIG. 6A with exemplary arcuate bearing segment 30 unscrolled to lie flat on the page, it is preferred that the outer bearing surface S of a segment 30 be sloped at an angle $\alpha$ to a plane P transverse to the centerline L of the bit substantially the same as the angle $\beta$ of the (helical path 140) traveled by associated PDC cutter 14 as the bit drills the borehole. By so orienting the outer bearing surface S, the full potential surface, or bearing area of bearing segment 30 contacts and remains in contact with the formation as the PDC cutter 14 rotates. As shown in FIG. 6B, the outer surface S of an arcuate segment may also be sloped at a variable angle to accommodate maximum and minimum design ROP for a bit. Thus, if a bit is designed to drill between 110 and 130 fph, the rotationally leading portion LS of surface S may be at one, relatively shallower angle $\gamma$, while the rotationally trailing portion TS of surface S (all of surface S still rotationally leading PDC cutter 14) may be at another, relatively steeper angle $\delta$, (both angles shown in exaggerated magnitude for clarity) the remainder of surface S gradually transitioning in an angle therebetween. In this manner, and since DOC must necessarily increase for ROP to increase, given a substantially constant rotational speed, at a first, shallower helix angle 140*a* corresponding to a lower ROP, the leading portion LS of surface S will be in contact with the formation being drilled, while at a higher ROP the helix angle will steepen, as shown (exaggerated for clarity) by helix angle 140*b* and leading portion LS will no longer contact the formation, the contact area being transitioned to more steeply angled trailing portion TS. Of course, at an ROP intermediate the upper and lower limits of the design range, a portion of surface S intermediate leading portion LS and trailing portion TS (or portions of both LS and TS) would act as the bearing surface. A configuration as shown in FIG. 6B is readily suitable for high compressive strength formations at varying ROP's within a design range, since bearing surface area requirements for the DOCC features are nominal. For bits used in drilling softer formations, it may be necessary to provide excess surface area for each DOCC feature to prevent formation failure and indentation, as only a portion of each DOCC feature will be in contact with the formation at any one time when drilling over a design range of ROPs. Conversely, for bits used in drilling harder formations, providing excess surface area for each DOCC feature to prevent formation failure and indentation may not be necessary as the respective portions of each DOCC feature may, when taken in combination, provide enough total bearing surface area, or total size, for the bit to ride on the formation over a design range of ROPs.

Another consideration in the design of bits according to the present invention is the abrasivity of the formation being drilled, and relative wear rates of the DOCC features and the PDC cutters. In non-abrasive formations this is not of major concern, as neither the DOCC feature nor the PDC cutter will wear appreciably. However, in more abrasive formations, it may be necessary to provide wear inserts 32 (see FIG. 1) or otherwise protect the DOCC features against excessive (i.e., premature) wear in relation to the cutters with which they are associated to prevent reduction in DOC. For example, if the bit is a matrix-type bit, a layer of diamond grit may be embedded in the outer surfaces of the DOCC features. Alternatively, preformed cemented tungsten carbide slugs cast into the bit face may be used as DOCC features. A diamond film may be formed on selected portions of the bit face using known chemical vapor deposition techniques as known in the art, or diamond films formed on substrates which are then cast into or brazed or otherwise bonded to the bit body. Natural diamonds, thermally stable PDCs (commonly termed TSPs) or even PDCs with their faces substantially parallel to the helix angle of the cutter path (so that what would normally be the cutting face of the PDC acts as a bearing surface), or cubic boron nitride structures similar to the aforementioned diamond structures may also be employed on, or as, bearing surfaces of the DOCC features, as desired or required, for example when drilling in limestones and dolomites. In order to reduce frictional forces between a DOCC bearing surface and the formation, a very low roughness, so-called "polished" diamond surface may be employed in accordance with U.S. Pat. Nos. 5,447,208 and 5,653,300, assigned to the assignee of the present invention and hereby incorporated herein by this reference. Ideally, and taking into account wear of the diamond table and supporting substrate in comparison to wear of the DOCC features, the wear characteristics and volumes of materials taking the wear for the DOCC features may be adjusted so that the wear rate of the DOCC features may be substantially matched to the wear rate of the PDC cutters to maintain a substantially constant DOC. This approach will result in the ability to use the PDC cutter to its maximum potential life. It is, of course, understood that the DOCC features may be configured as abbreviated "knots," "bosses," or large "mesas" as well as the aforementioned arcuate segments or may be of any other configuration suitable for the formation to be drilled to prevent failure thereof by the DOCC features under expected or planned WOB.

As an alternative to a fixed, or passive, DOCC feature, it is also contemplated that active DOCC features or bearing segments may be employed to various ends. For example, rollers may be disposed in front of the cutters to provide reduced-friction DOCC features, or a fluid bearing comprising an aperture surrounded by a pad or mesa on the bit face may be employed to provide a standoff for the cutters with attendant low friction. Movable DOCC features, for example pivotable structures, might also be used to accommodate variations in ROP within a given range by tilting the bearing surfaces of the DOCC features so that the surfaces are oriented at the same angle as the helical path of the associated cutters.

Figure 7:
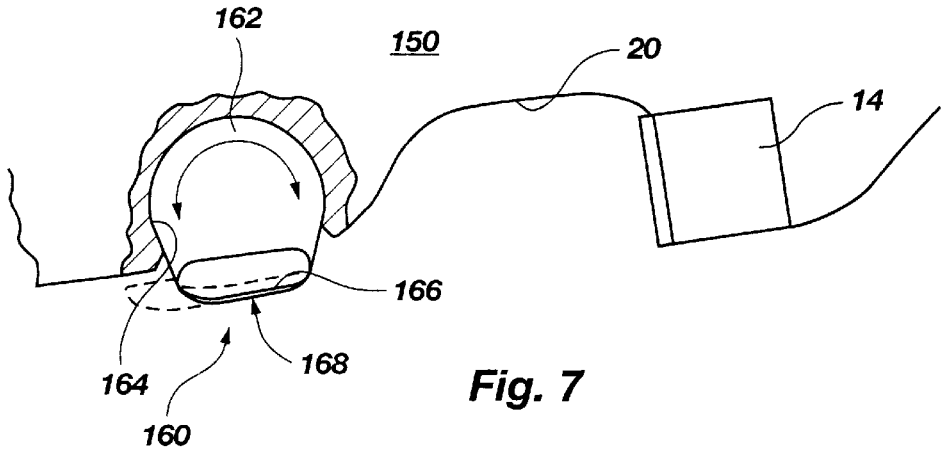
FIGS. 7 and 7A are, respectively, a schematic side partial sectional elevation of an embodiment of a pivotable DOCC feature and associated trailing PDC cutter, and an elevation looking forward at the pivotable DOCC feature from the location of the associated PDC cutter.

Referring now to FIGS. 7 though 12 of the drawings, various DOCC features (which may also be referred to as bearing segments) according to the invention are disclosed.

Figure 7A:
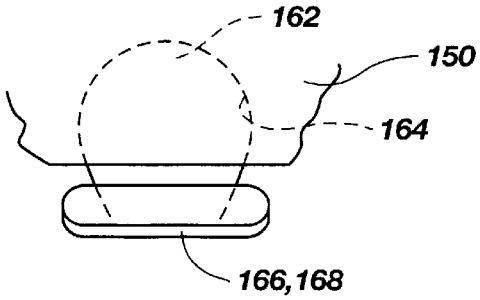

Referring to FIGS. 7 and 7A, exemplary bit 150 having PDC cutter 14 secured thereto rotationally trailing fluid course 20 includes pivotable DOCC feature 160 comprised of an arcuate-surfaced body 162 (which may comprise a hemisphere for rotation about several axes or merely an arcuate surface extending transverse to the plane of the page for rotation about an axis transverse to the page) secured in socket 164 and having an optional wear-resistant feature 166 on the bearing surface 168 thereof Wear-resistant feature 166 may merely be an exposed portion of the material of body 162 if the latter is formed of, for example, WC. Alternatively, wear-resistant feature 166 may comprise a WC tip, insert or cladding on bearing surface 168 of body 162, diamond grit embedded in body 162 at bearing surface 168, or a synthetic or natural diamond surface treatment of bearing surface 168, including specifically and without limitation, a diamond film deposited thereon or bonded thereto. It should be noted that the area of the bearing surface 168 of the DOCC feature 160 which will ride on the formation being drilled, as well as the DOC for PDC cutter 14, may be easily adjusted for a given bit design by using bodies 162 exhibiting different exposures (heights) of the bearing surface 168 and different widths, lengths or cross-sectional configurations, all as shown in broken lines. Thus, different formation compressive strengths may be accommodated. The use of a pivotable DOCC feature 160 permits the DOCC feature to automatically adjust to different ROPs within a given range of cutter helix angles. While DOC may be affected by pivoting of the DOCC feature 160, variation within a given range of ROPs will usually be nominal.

Figure 8:
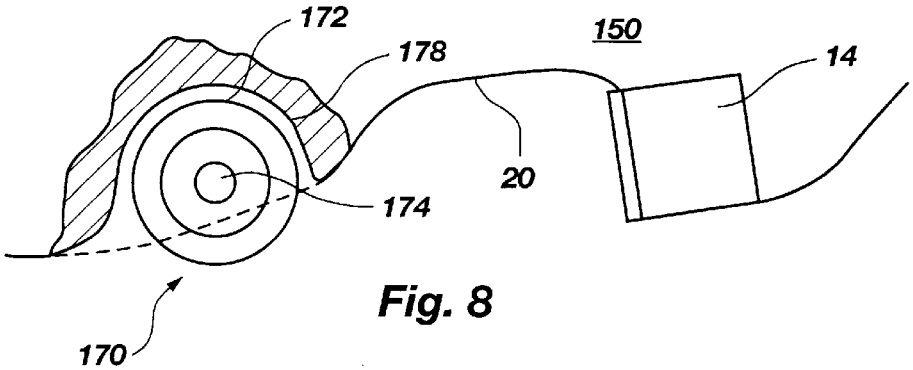
FIGS. 8 and 8A are, respectively, a schematic side partial sectional elevation of an embodiment of a roller-type DOCC feature and associated trailing cutter, and a transverse partial cross-sectional view of the mounting of the roller-type DOCC features to the bit.
Figure 8A:
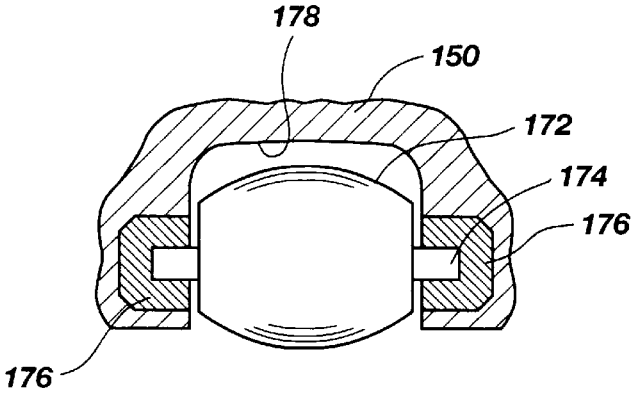
Figure 9A:
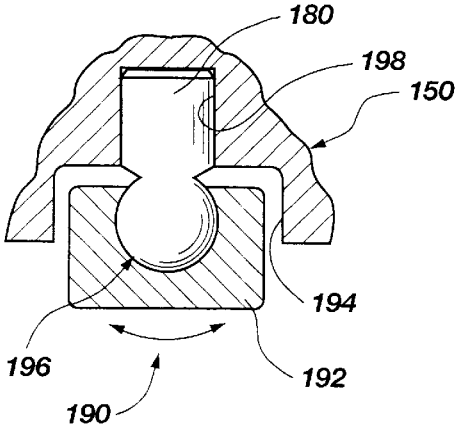
FIGS. 9A–9D depict additional schematic partial sectional elevations of further pivotable DOCC features according to the invention.
Figure 9B:
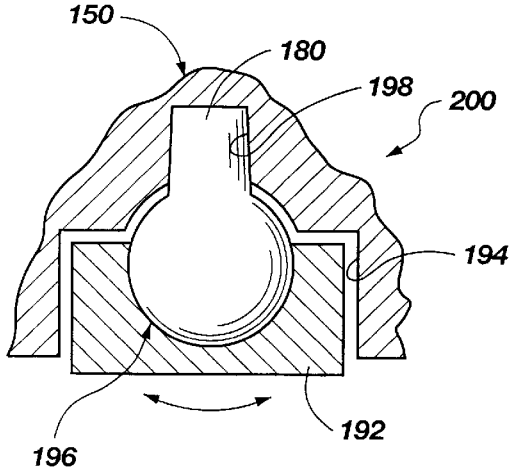
Figure 9C:
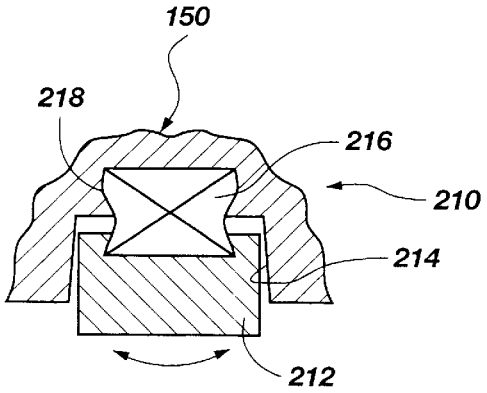
Figure 9D:
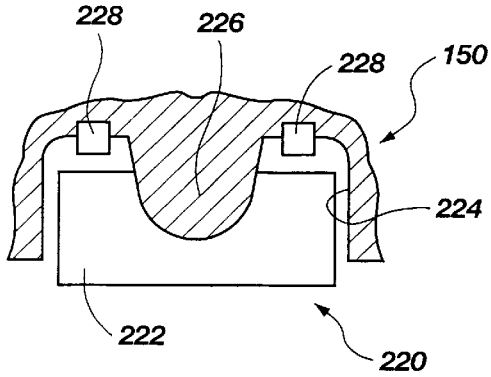

FIGS. 8 and 8A depict exemplary bit 150 having PDC cutter 14 secured thereto rotationally trailing fluid course 20, wherein bit 150 in this instance includes DOCC feature 170 including roller 172 rotationally mounted by shaft 174 to bearings 176 carried by bit 150 on each side of cavity 178 in which roller 172 is partially received. In this embodiment, it should be noted that the exposure and bearing surface area of DOCC feature 170 may be easily adjusted for a given bit design by using different diameter rollers 172 exhibiting different widths and/or cross-sectional configurations.

FIGS. 9A, 9B, 9C and 9D respectively depict alternative pivotable DOCC features 190, 200, 210 and 220. DOCC feature 190 includes a head 192 partially received in a cavity 194 in a bit 150 and mounted through a ball and socket connection 196 to a stud 180 press-fit into aperture 198 at the top of cavity 194. DOCC features 200, wherein elements similar to those of DOCC feature 190 are identified by the same reference numerals, is a variation of DOCC feature 190. DOCC feature 210 employs a head 212 which is partially received in a cavity 214 in a bit 150 and secured thereto by a resilient or ductile connecting element 216 which extends into aperture 218 at the top of cavity 214. Connecting element 216 may comprise, for example, an elastomeric block, a coil spring, a belleville spring, a leaf spring, or a block of ductile metal, such as steel or bronze. Thus, connecting element 216, as with the ball and socket connections 196 and heads 192, permits head 212 to automatically adjust to, or compensate for, varying ROPs defining different cutter helix angles. DOCC feature 220 employs a yoke 222 rotationally disposed and partially received within cavity 224, yoke 222 supported on protrusion 226 of bit 150. Stops 228, of resilient or ductile materials (such as elastomers, steel, lead, etc.) and which may be permanent or replaceable, permit yoke 222 to accommodate various helix angles. Yoke 222 may be secured within cavity 224 by any conventional means. Since helix angles vary even for a given, specific ROP as distance of each cutter from the bit centerline, affording such automatic adjustment or compensation may be preferable to trying to form DOCC features with bearing surfaces at different angles at different locations over the bit face.

Figure 10A:
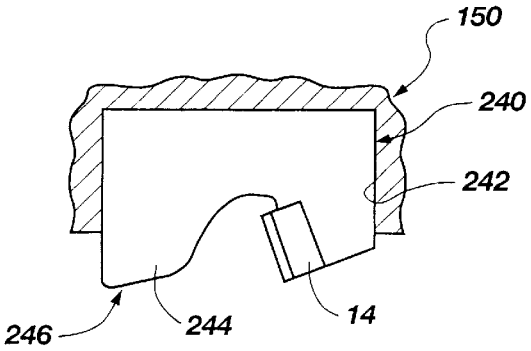
FIGS. 10A and 10B are schematic side partial sectional elevations of variations of a combination cutter carrier and DOCC features according to the present invention.
Figure 10B:
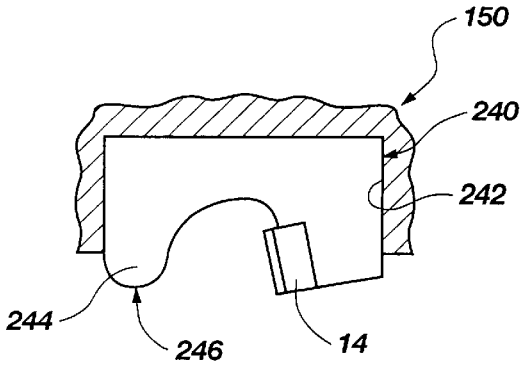

FIGS. 10A and 10B respectively depict different DOCC features and PDC cutter combinations. In each instance, a PDC cutter 14 is secured to a combined cutter carrier and DOC limiter 240, the carrier 240 being received within a cavity 242 in the face (or on a blade) of an exemplary bit 150 and secured therein as by brazing, welding, mechanical fastening, or otherwise as known in the art. DOC limiter 240 includes a protrusion 244 exhibiting a bearing surface 246. As shown and by way of example only, bearing surface 246 may be substantially flat (FIG. 10A) or hemispherical (FIG. 10B). By selecting an appropriate cutter carrier and DOC limiter 240, the DOC of PDC cutter 14 may be varied and the surface area of bearing surface 246 adjusted to accommodate a target formation's compressive strength.

It should be noted that the DOCC features of FIGS. 7 through 10, in addition to accommodating different formation compressive strengths as well as optimizing DOC and permitting minimization of friction-causing bearing surface area while preventing formation failure under WOB, also facilitate field repair and replacement of DOCC features due to drilling damage or to accommodate different formations to be drilled in adjacent formations, or intervals, to be penetrated by the same borehole.

Figure 11:
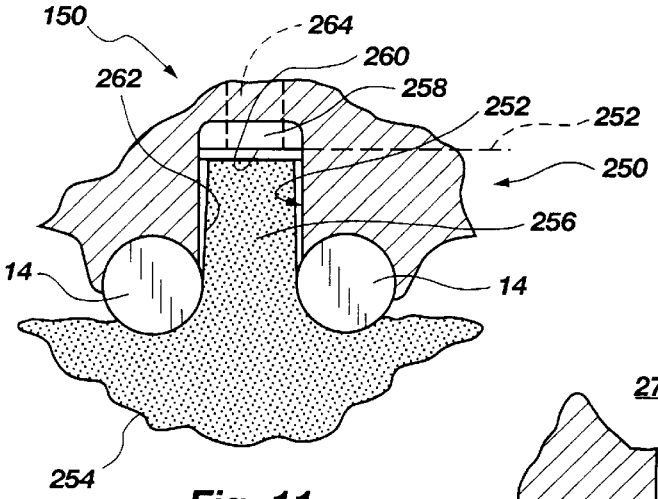
FIG. 11 is a frontal elevation of an annular channel-type DOCC feature in combination with associated trailing PDC cutters.

FIG. 11 depicts a DOCC feature 250 comprised of an annular cavity or channel 252 in the face of an exemplary bit 150. Radially adjacent PDC cutters 14 flanking annular channel 252 cut the formation 254 but for uncut annular segment 256, which protrudes into annular cavity 252. At the top 260 of annular channel 252, a flat-edged PDC cutter 258 (or preferably a plurality of rotationally spaced cutters 258) truncates annular segment 256 in a controlled manner so that the height of annular segment 256 remains substantially constant and limits the DOC of flanking PDC cutters 14. In this instance, the bearing surface of the DOCC feature 250 comprises the top 260 of annular channel 252, and the sides 262 of channel 252 prevent collapse of annular segment 256. Of course, it is understood that multiple annular channels 252 with flanking PDC cutters 14 may be employed, and that a source of drilling fluid, such as aperture 264, would be provided to lubricate channel 252 and flush formation cuttings from cutter 258.

Figure 12:
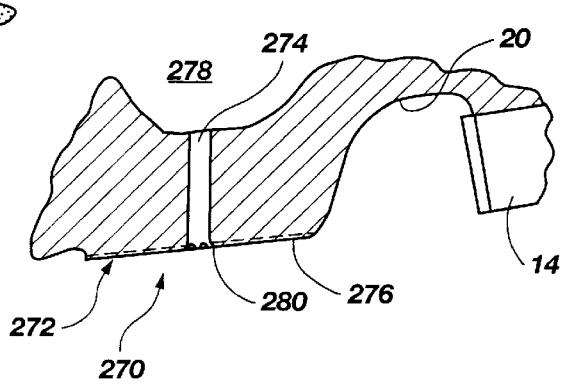
FIGS. 12 and 12A are, respectively, a schematic side partial sectional elevation of a fluid bearing pad-type DOCC feature according to the present invention and an associated trailing PDC cutter and an elevation looking upward at the bearing surface of the pad.
Figure 12A:
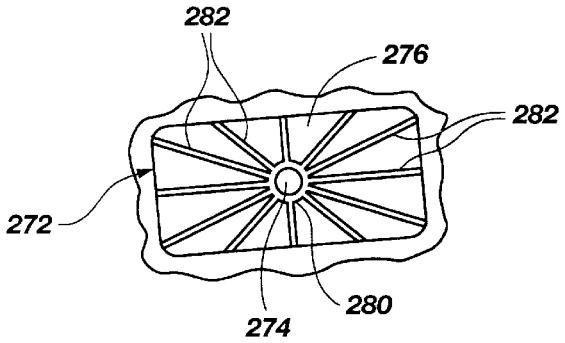

FIGS. 12 and 12A depict a low-friction, hydraulically enhanced DOCC feature 270 comprised of a DOCC pad 272 rotationally leading a PDC cutter 14 across fluid course 20 on exemplary bit 150, pad 272 being provided with drilling fluid through passage 274 leading to the bearing surface 276 of pad 272 from a plenum 278 inside the body of bit 150. As shown in FIG. 12A, a plurality of channels 282 may be formed on bearing surface 276 to facilitate distribution of drilling fluid from the mouth 280 of passage 274 across bearing surface 276. By diverting a small portion of drilling fluid flow to the bit 150 from its normal path leading to nozzles associated with the cutters, it is believed that the increased friction normally attendant with WOB increases after the bearing surface 276 of DOCC pad 272 contacts the formation may be at least somewhat alleviated, and in some instances substantially avoided, reducing or eliminating torque increases responsive to increases of WOB. Of course, passages 274 may be sized to provide appropriate flow, or pads 272 sized with appropriately dimensioned mouths 280. Pads 272 may, of course, be configured for replaceability.

As has been mentioned above, backrakes of the PDC cutters employed in a bit equipped with DOCC features according to the invention may be more aggressive, that is to say, less negative, than with conventional bits. It is also contemplated that extremely aggressive cutter rakes, including neutral rakes and even positive (forward) rakes of the cutters may be successfully employed consistent with the cutters' inherent strength to withstand the loading thereon as a consequence of such rakes, since the DOCC features will prevent such aggressive cutters from engaging the formation to too great a depth.

It is also contemplated that two different heights, or exposures, of bearing segments may be employed on a bit, a set of higher bearing segments providing a first bearing surface area supporting the bit on harder, higher compressive strength formations providing a relatively shallow DOC for the PDC cutters of the bit, while a set of lower bearing segments remains out of contact with the formation while drilling until a softer, lower compressive stress formation is encountered. At that juncture, the higher or more exposed bearing segments will be of insufficient surface area to prevent indentation (failure) of the formation rock under applied WOB. Thus, the higher bearing segments will indent the formation until the second set of bearing segments comes in contact therewith, whereupon the combined surface area of the two sets of bearing segments will support the bit on the softer formation, but at a greater DOC to permit the cutters to remove a greater volume of formation material per rotation of the bit and thus generate a higher ROP for a given bit rotational speed. This approach differs from the approach illustrated in FIG. 5 in that, unlike stepped DOCC features (bearing segment 130), bearing segments of differing heights or exposures are associated with different cutters. Thus, this aspect of the invention may be effected, for example, in the bits 10 and 100 of FIGS. 1 and 2 by fabricating selected arcuate bearing segments to a greater height or exposure than others. Thus, bearing segments 30*b* and 30*e* of bits 10 and 100 may exhibit a greater exposure than segments 30*a,* 3*c,* 30*d* and 30*f,* or vice versa.

Cutters employed with bits 10 and 100, as well as other bits disclosed that will be discussed subsequently herein, are depicted as having PDC cutters 14, but it will be recognized and appreciated by those of ordinary skill in the art that the invention may also be practiced on bits carrying other types of superabrasive cutters, such as thermally stable polycrystalline diamond compacts, or TSPs, for example arranged into a mosaic pattern as known in the art to simulate the cutting face of a PDC. Diamond film cutters may also be employed, as well as cubic boron nitride compacts.

Another embodiment of the present invention, as exemplified by rotary drill bit 300 and 300', is depicted in FIGS. 14A–20. Rotary drill bits such as drill bits 300 and 300', according to the present invention, may include many features and elements which correspond to those identified with respect to previously described and illustrated bits 10 and 100.

Figure 14A:
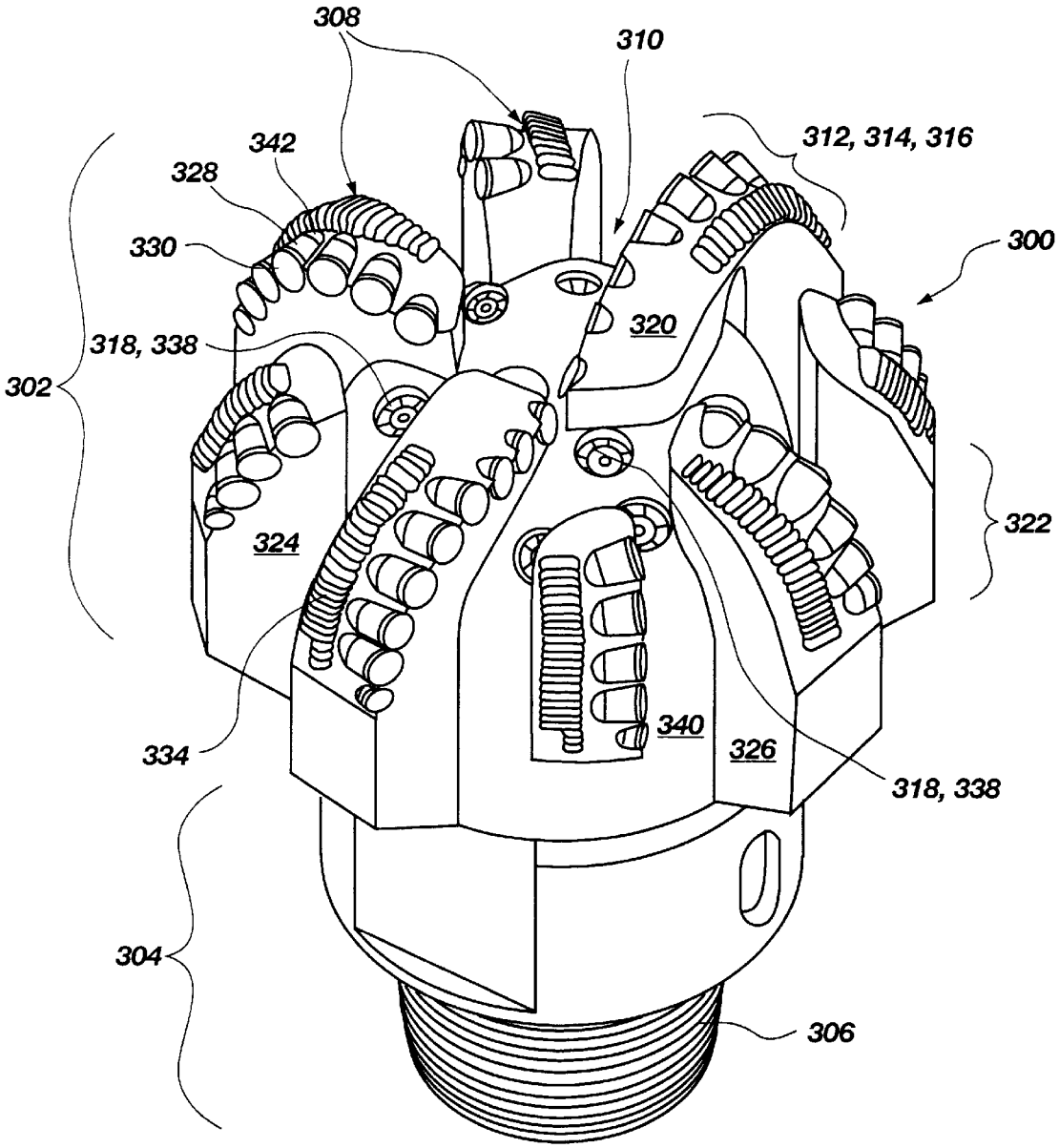
FIG. 14A is a perspective view of the face of one embodiment of a drill bit having eight blade structures including reduced exposure cutters disposed on at least some of the blades in accordance with the present invention.
Figure 14B:
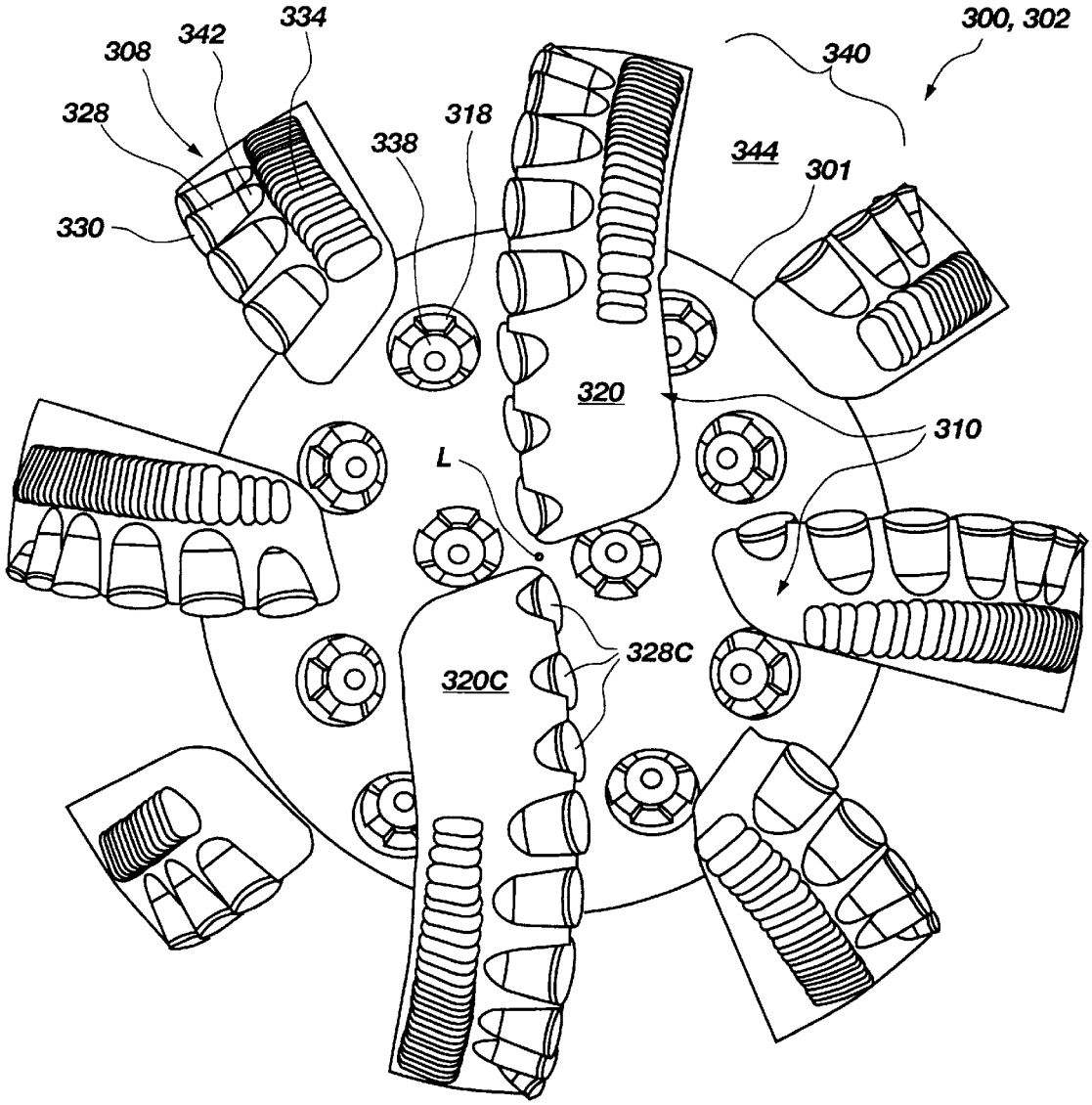
FIG. 14B is a bottom view of the face of the exemplary drill bit of FIG. 14A.
Figure 14C:
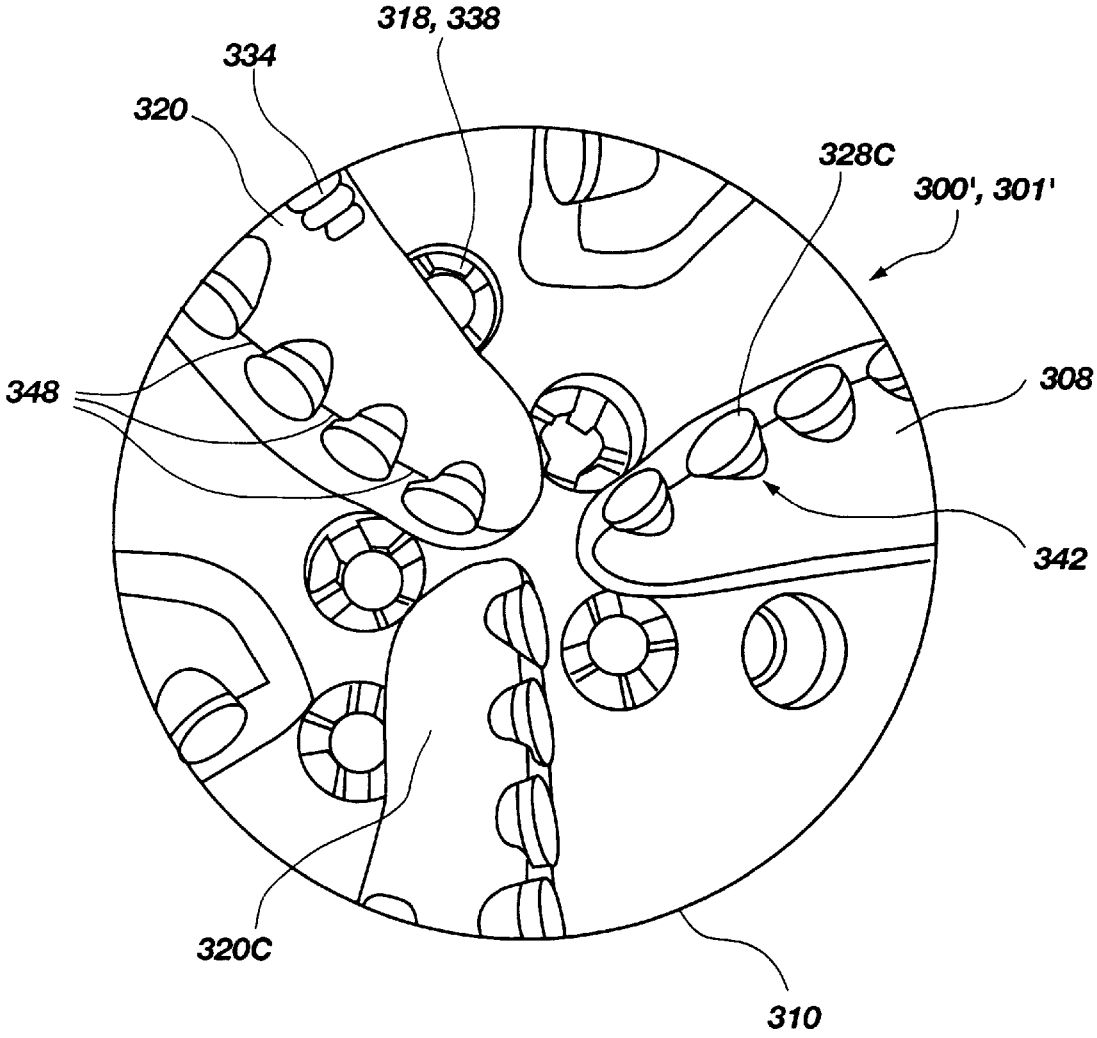
FIG. 14C is a photographic bottom view of the face of another exemplary drill bit embodying the present invention having six blade structures and a different cutter profile than the cutter profile of the exemplary bit illustrated in FIGS. 14A and 14B.

Representative rotary drill bit 300 shown in FIGS. 14A and 14B, includes a bit body 301 having a leading end 302 and a trailing end 304. Connection 306 may comprise a pin-end connection having tapered threads for connecting bit 300 to a bottom hole assembly of a conventional rotating drill string, or alternatively for connection to a downhole motor assembly such as a drilling fluid powered Moineau-type downhole motor, as described earlier. Leading end, or drill bit face, 302 includes a plurality of blade structures 308 generally extending radially outwardly and longitudinally toward trailing end 304. Exemplary bit 300 comprises eight blade structures, or blades, 308 spaced circumferentially about the bit. However, a fewer number of blades may be provided on a bit such as provided on bit body 301' of bit 300' shown in FIG. 14C which has six blades. A greater number of blade structures of a variety of geometries may be utilized as determined to be optimum for a particular drill bit. Furthermore, blades 308 need not be equidistantly spaced about the circumference of drill bit 300 as shown, but may be spaced about the circumference, or periphery, of a bit in any suitable fashion including a non-equidistant arrangement or an arrangement wherein some of the blades are spaced circumferentially equidistantly from each other and wherein some of the blades are irregularly, non-equidistantly spaced from each other. Moreover, blades 308 need not be specifically configured in the manner as shown in FIGS. 14A and 14B, but may be configured to include other profiles, sizes, and combinations than those shown.

Generally, a bit, such as bit 300, includes a cone region 310, a nose region 312, a flank region 314, a shoulder region 316, and a gage region 322. Frequently, a specific distinction between flank region 314 and shoulder region 316 may not be made. Thus, the term "shoulder," as used in the art, will often incorporate the "flank" region within the "shoulder" region. Fluid ports 318 are disposed about the face of the bit and are in fluid communication with at least one interior passage provided in the interior of bit body 301 in a manner such as illustrated in FIG. 2A of the drawings and for the purposes described previously herein. Preferably, but not necessarily, fluid ports 318 include nozzles 338 disposed therein to better control the expulsion of drilling fluid from bit body 301 into fluid courses 344 and junk slots 340 in order to facilitate the cooling of cutters on bit 300 and the flushing of formation cuttings up the borehole toward the surface when bit 300 is in operation.

Blades 308 preferably comprise, in addition to gage region 322 of blades 308, a radially outward facing bearing surface 320, a rotationally leading surface 324, and a rotationally trailing surface 326. That is, as the bit is rotated in a subterranean formation to create a borehole, leading surface 324 will be facing the intended direction of bit rotation while trailing surface 326 will be facing opposite, or backwards from, the intended direction of bit rotation. A plurality of cutting elements, or cutters, 328 are preferably disposed along and partially within blades 308. Specifically, cutters 328 are positioned so as to have a superabrasive cutting face, or table, 330 generally facing in the same direction as leading surface 324 as well as to be exposed to a certain extent beyond bearing surface 320 of the respective blade in which each cutter is positioned. Cutters 328 are preferably superabrasive cutting elements known within the art, such as the exemplary PDC cutters described previously herein, and are physically secured in pockets 342 by installation and securement techniques known in the art. The preferred amount of exposure of cutters 328 in accordance with the present invention will be described in further detail hereinbelow.

Optional wear knots, wear clouds, or built-up wear-resistant areas 334, collectively referred to as wear knots 334 herein, may be disposed upon, or otherwise provided on bearing surfaces 320 of blades 308 with wear knots 334 preferably being positioned so as to rotationally follow cutters 328 positioned on respective blades or other surfaces in which cutters 328 are disposed. Wear knots 334 may be originally molded into bit 300 or may be added to selected portions of bearing surface 320. As described earlier herein, bearing surfaces 320 of blades 308 may be provided with other wear-resistant features or characteristics such as embedded diamonds, TSPs, PDCs, hard facing, weldings, and weldments for example. As will become apparent, such wear-resistant features can be employed to further enhance and augment the DOCC aspect as well as other beneficial aspects of the present invention.

Figure 15B:
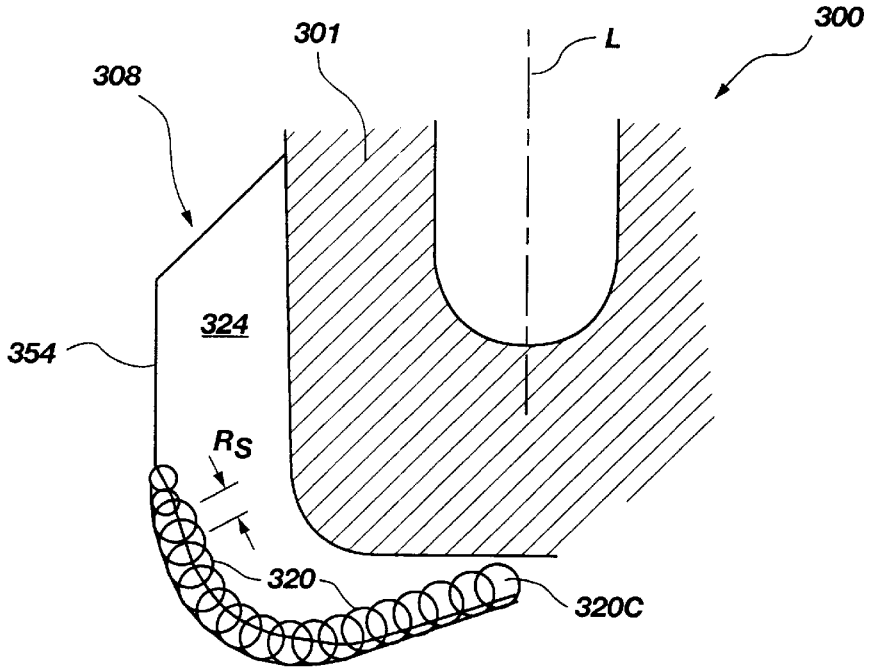
FIG. 15B is a schematic side partial sectional view showing the combined cutter profile, including cutter-to-cutter overlap of the cutters positioned along all the blades, as superimposed upon a single, representative blade.
Figure 15A:
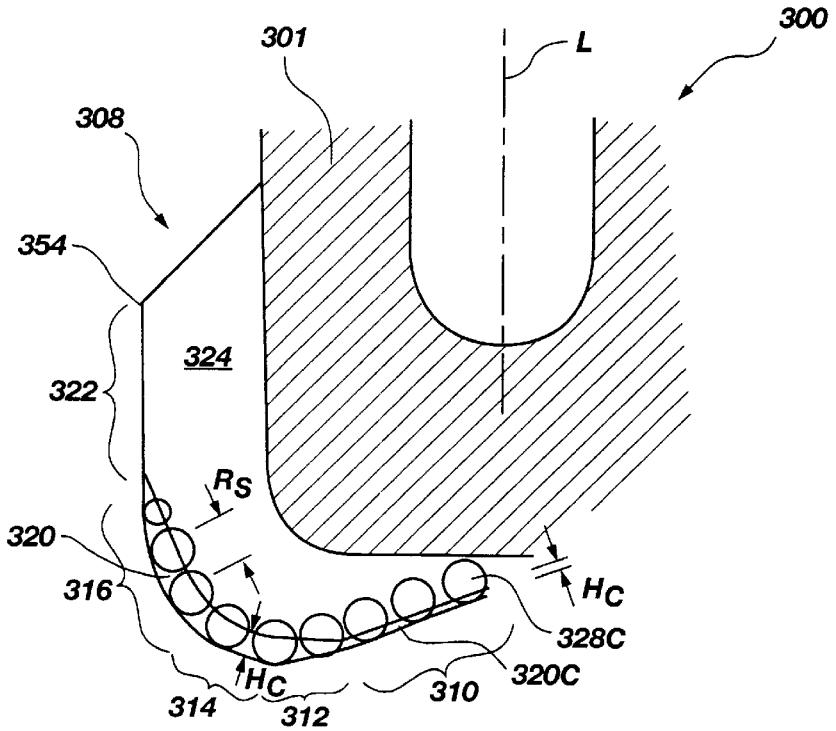
FIG. 15A is a schematic side partial sectional view showing the cutter profile and radial spacing of adjacently positioned cutters along a single, representative blade of a drill bit embodying the present invention.
Figure 15C:
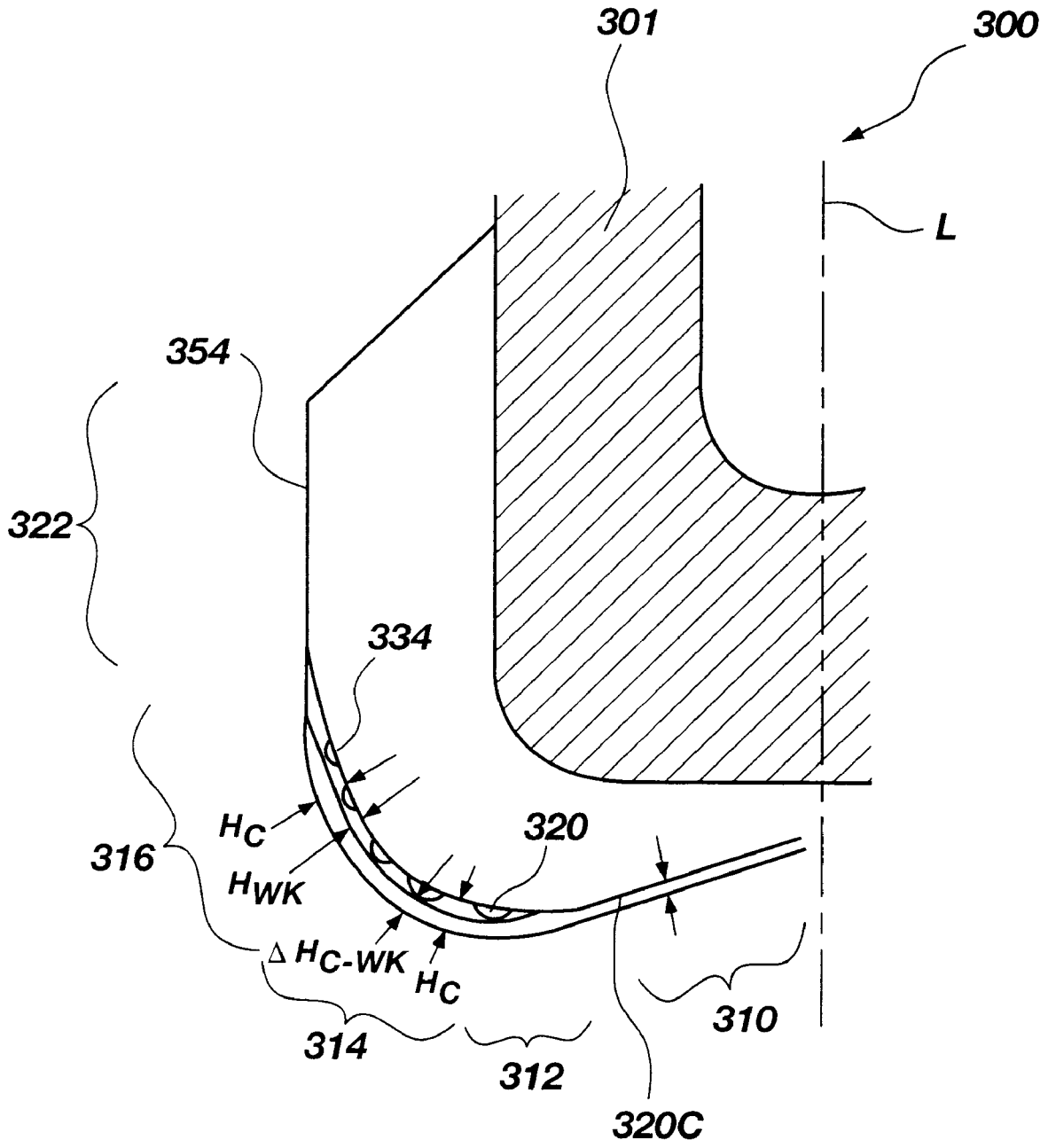
FIG. 15C is a schematic side partial sectional view showing the extent of cutter exposure along the cutter profile as illustrated in FIGS. 15A and 15B with the cutters removed for clarity and further shows a representative, optional wear knot, or wear cloud, profile.

FIGS. 15A–15C highlight the extent in which cutters 328 are exposed with respect to the surface immediately surrounding cutters 328 and particularly cutters 328C located within the radially innermost region of the leading end of a bit proximate the longitudinal centerline of the bit. FIG. 15A provides a schematic representation of a representative group of cutters provided on a bit as the bit rotatingly engages a formation with the cutter profile taken in cross-section and projected onto a single, representative vertical plane (i.e., the drawing sheet). Cutters 328 are generally radially, or laterally, positioned along the face of the leading end of a bit, such as representative bit 300, so as to provide a selected center-to-center radial, or lateral spacing between cutters referred to as center-to-center cutter spacing $R_s$. Thus, if a bit is provided with a blade structure, such as blade 308, the cutter profile of 15A represents the cutters positioned on a single representative blade 308. As exaggeratedly illustrated in FIG. 15A, cutters 328C located in cone region 310 are preferably disposed into blade 308 so as to have a cutter exposure $H_c$ generally perpendicular to the outwardly face bearing surface 320 of blade 308 by a selected amount. As can be seen in FIG. 15A, cutter exposure $H_c$ is of a preferably relative small amount of standoff, or exposure, distance in cone region 310 of bit 300. Preferably, cutter exposure $H_c$ generally differs for each of the cutters or groups of cutters positioned more radially distant from centerline L. For example cutter exposure $H_c$ is generally greater for cutters 328 in nose region 312 than it is for cutters 328 located in cone region 310 and cutter exposure $H_c$ is preferably at a maximum in flank/shoulder regions 314/316. Cutter exposure $H_c$ preferably diminishes slightly radially toward gage region 322, and radially outermost cutters 328 positioned longitudinally proximate gage pad surface 354 of gage region 322 may incorporate cutting faces of smaller cross-sectional diameters as illustrated. Gage line 352 (see FIGS. 16 and 17) defines the maximum outside diameter of bit 300.

The cross-sectional profile of optional wear knots, wear clouds, hard facing, or surface welds 334 have been omitted for clarity in FIG. 15A. However, FIG. 15C depicts the rotational cross-sectional profile, as superimposed upon a single, representative vertical plane, of representative optional wear knots, wear clouds, hard facing, surface welds, or other wear knot structures 334. FIG. 15C further illustrates an exemplary cross-sectional wear knot height $H_{wk}$ measured generally perpendicular to outwardly face bearing surface 320. There may or may not be a generally radial dimensional difference, or relief, $\Delta H_{c\text{-}wk}$, between wear knot height $H_{wk}$, which generally corresponds to a radially outermost surface of a given wear knot or structure, and respective cutter exposure $H_c$, which generally corresponds to the radially outermost portion of the rotationally associated cutter, to further provide a DOCC feature in accordance with the present invention. Conceptually, these differences in exposures can be regarded as analogous to the distance of cutter 14 and rotationally trailing DOC limiter 50 as measured from the dashed reference line illustrated in FIG. 4 and as described earlier. Furthermore, instead of referring to the distance in which the radially outermost surface of a given wear knot structure is positioned radially outward from a bearing surface or blade structure in which a particular wear knot structure is disposed upon, it may be helpful to alternatively refer to a preselected distance in which the radially outermost surface of a given wear knot structure is radially/longitudinally inset, or relieved from the outermost portion of the exposed portion of a rotationally associated superabrasive cutter as denoted as $\Delta H_{c\text{-}wk}$ in FIG. 15C. Thus, in addition to controlling the DOC with at least certain cutters, and perhaps every cutter, by selecting an appropriate cutter exposure height $H_c$ as defined and illustrated herein, the present invention further encompasses optionally providing drill bits with wear knots, or other similar cutter depth limiting structures, to complement, or augment, the control of the DOCs of respectively rotationally associated cutters wherein such optionally provided wear knots are disposed on the bit so as to have a wear knot surface that is positioned, or relieved, a preselected distance $\Delta H_{c\text{-}wk}$ as measured from the outermost exposed portion of the cutter in which a wear knot is rotationally associated to the wear knot surface.

The superimposed cross-sectional cutter profile of a representative drill bit such as bit 300 in FIG. 15B depicts the combined profile of all cutters installed on each of a plurality of blades 308 so as to have a selected center-to-center radial cutter spacing $R_s$. Thus, the cutter profile illustrated in FIG. 15B is the result of all of the cutters provided on a plurality of blades and rotated about the centerline of the bit to be superimposed upon a single, representative blade 308. In some embodiments, there will likely be several cutter redundancies at identical radial locations between various cutters positioned on respective, circumferentially spaced blades, and, for clarity, such profiles which are perfectly, or absolutely, redundant are typically not illustrated. As can be seen in FIG. 15B, there will be a lateral, or radial, overlap between respective cutter paths as the variously provided cutters rotationally progress generally tangential to longitudinal axis L as the bit 300 rotates so as to result in a uniform cutting action being achieved as the drill bit rotatingly engages a formation under a selected WOB. Additionally, it can be seen in FIG. 15B that the lateral, or radial, spacing between individual cutter profiles need not be of the same, uniform distance with respect to the radial, or lateral, position of each cutter. This non-uniform spacing with respect to the radial, or lateral, positioning of each cutter is more clearly illustrated in FIGS. 16 and 17.

Figure 16:
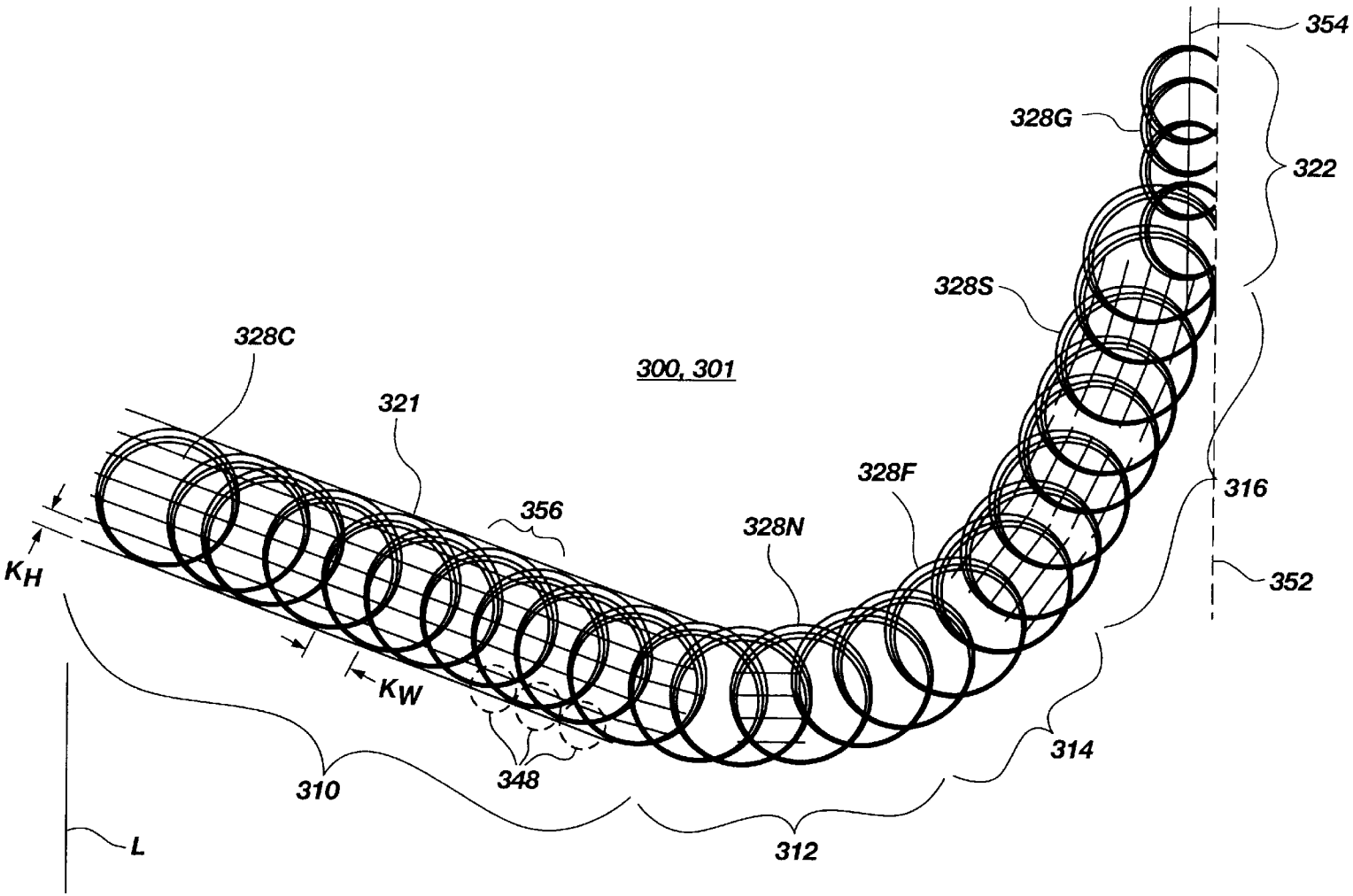
FIG. 16 is an enlarged, isolated schematic side partial sectional view illustrating an exemplary superimposed cutter profile having a relative low amount of cutter overlap in accordance with the present invention.
Figure 17:
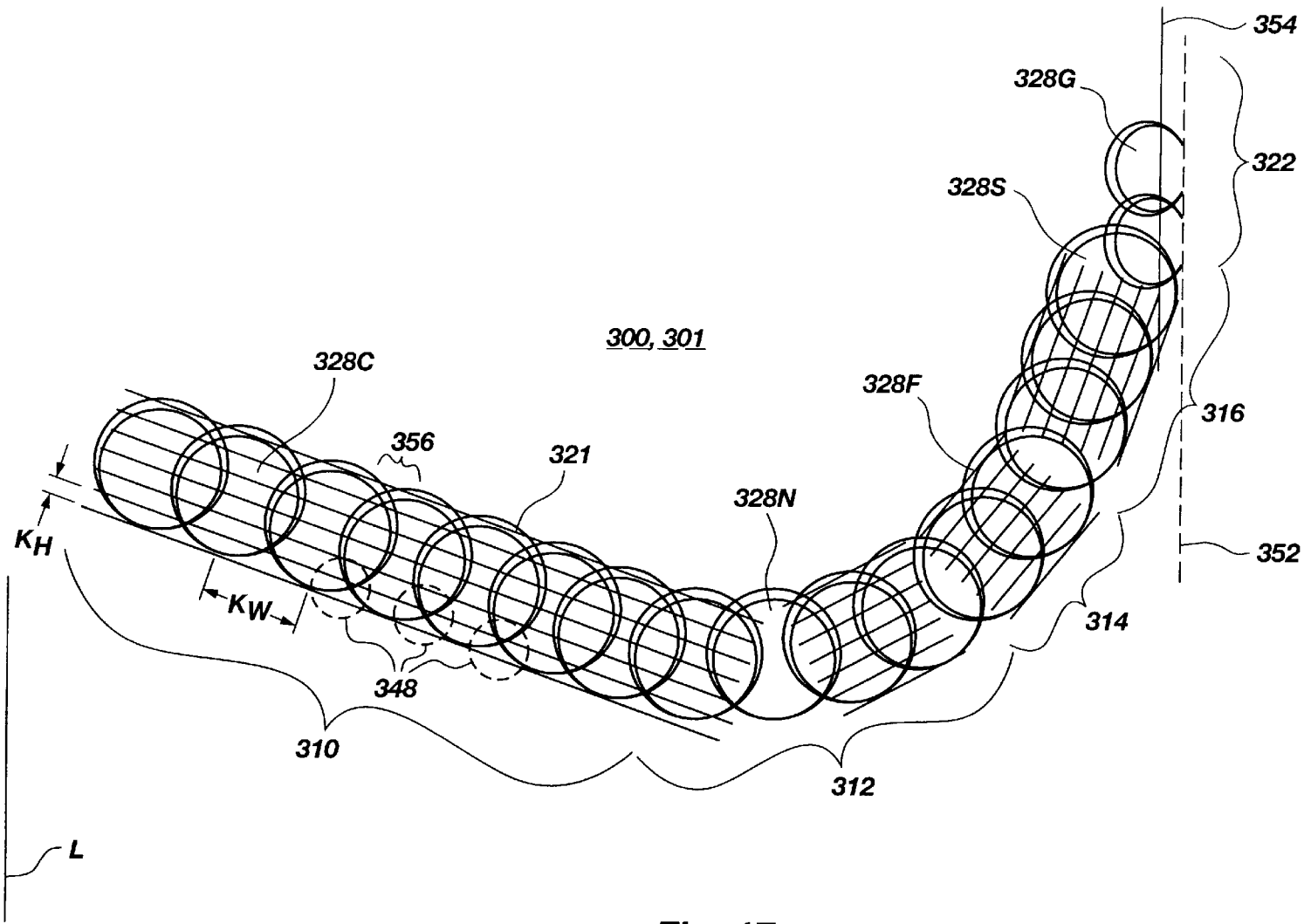
FIG. 17 is an enlarged, isolated schematic side partial sectional view illustrating an exemplary superimposed cutter profile having a relative high amount of cutter overlap in accordance with the present invention.

FIGS. 16 and 17 are enlarged, isolated partial cross-sectional cutter profile views to which all of the cutters located on a bit are superimposed as if on a single cross-sectional portion of a bit body 301 or cutters 328 of a bit such as bit 300. The cutter profiles of FIGS. 16 and 17 are illustrated as being to the right of longitudinal centerline L of a representative bit such as bit 300 instead of the left as illustrated in FIGS. 15A–15C. As described the leading end of bit 300 includes cone region 310 which includes cutters 328C, nose region 312 which includes cutters 328N, flank region 314 which includes cutters 328F, shoulder region 316 which includes cutters 328S, and gage region 322 which includes cutters 328G wherein the cutters in each region may be referred to collectively as cutters 328. FIG. 16 illustrates a cutter profile exhibiting a high degree, or amount, of cutter overlap 356. That is, cutters 328 as illustrated in FIG. 17 are provided in sufficient quantity and are positioned sufficiently close to each other laterally, or radially, so as to provide a high degree of cutter redundancy as the bit rotates and engages the formation. In contrast, the representative cutter profile illustrated in FIG. 17 exhibits a relatively lower degree, or amount, of cutter overlap 356. That is, the total number of cutters 328 is less in quantity and are spaced further apart with respect to the radial, or lateral, distance between individual, rotationally adjacent cutter profiles. Kerf regions 348, shown in phantom, in FIGS. 16 and 17 reveal a relatively small height for kerf regions 348 of FIG. 16 wherein kerf regions of FIGS. 17 are significantly higher. To aid in the illustration of the respective differences in individual kerf region height $K_H$, which, as a practical matter, is directly related to cutter exposure height $H_C$, as well as individual kerf region widths $K_w$ which are directly influenced by the extent of radial overlap of cutters respectively positioned on different blades, a scaled reference grid of a plurality of parallel spaced lines is provided in FIGS. 16 and 17 to highlight the cutter exposure height and kerf region widths. The spacing between the grid lines in FIGS. 16 and 17 are scaled to represent approximately 0.125 of an inch. However, such a 0.125, or ⅛ inch, scale grid is merely exemplary, as dimensionally greater as well as dimensionally smaller cutter exposure heights, kerf region heights, and kerf region widths may be used in accordance with the present invention. The superimposed cutter profile of cutters 328 is illustrated with each of the represented cutters 328 being generally equidistantly spaced along the face of the bit from centerline L toward gage region 322; however, such need not be the case. For example, cutters 328C may have a cutter profile exhibiting more cutter overlap 356 resulting in a small kerf widths in cone region 310 as compared to a cutter profile of cutters 328N, 328F, and 328S respectively located in nose region 312, flank region 314, and shoulder region 316 wherein such more radially outward positioned cutters would have less overlap resulting in larger kerf widths therein, or vice versa. Thus, by selectively incorporating the amount of cutter overlap 356 to be provided in each region of a bit, the depth of cut of the cutters in combination with selecting the degree or amount of cutter exposure height of each cutter located in each particular region may be utilized to specifically and precisely control the depth of cut in each region as well as to design into the bit the amount of available bearing surface surrounding the cutters to which the bit may ride upon the formation. Stated differently, the wider the kerf width $K_w$ between the collective, superimposed, individual cutter profiles of all the cutters on all of the blades, or alternatively all the cutters radially and circumferentially spaced about a bit, such as cutters 328 provided on a bit such as shown in FIG. 17, a greater proportion of the total applied WOB will be dispersed upon the formation allowing the bit to "ride" on the formation than would be the case if a greater quantity of cutters were provided having a smaller kerf width $K_w$ therebetween as shown in FIG. 16.

Therefore, the cutter profile illustrated in FIG. 17 would result in a considerable portion of the WOB being applied to bit 300 to be dispersed over the wide kerfs and thereby allowing bit 300 to be supported by the formation as cutters 328 engage the formation. This feature of selecting both the total number of kerfs and the widths of the individual kerf widths $K_w$ allows for a precise control of the individual depth-of-cuts of the cutters adjacent the kerfs, as well as the total collective depth-of-cut of bit 300 into a formation of a given hardness. Upon a great enough, or amount of, WOB being applied on the bit when drilling in a given relatively hard formation the kerf regions 348 would come to ride upon the formation, thereby limiting, or arresting, the DOC of cutters 328. If yet further WOB were to be applied, the DOC would not increase as the kerf regions 348, as well as portions of the outwardly facing surface of the blade surrounding each cutter 328 provided with a reduced amount of exposure in accordance with the present invention, would, in combination, provide a total amount of bearing surface to support the bit in the relative hard formation, notwithstanding an excessive amount of WOB being applied to the bit in light of the current ROP.

Contrastingly, in a bit provided with a cutter profile exhibiting dimensionally small cutter-to-cutter spacings by incorporating a relatively high quantity of cutters 328 with a small kerf region $K_w$ between mutually radially, or laterally, overlapped cutters such as illustrated in FIG. 16, each individual cutter would engage the formation with a lesser amount of DOC per cutter at a given WOB. Because each cutter would engage the formation at a lesser DOC as compared with the cutter profile of FIG. 17, with all other variables being held constant, the cutters of the cutter profile of FIG. 16 would tend to be better suited for engaging a relative hard formation where a large DOC is not needed, and is in fact not preferred, for engaging and cutting a hard formation efficiently. Upon a requisite, or excessive amount of WOB further being applied on a bit having the cutter profile of FIG. 16 in light of the current ROP being afforded by the bit, kerf regions 348 would come to ride upon the formation, as well as other portions of the outwardly facing blade surface surround each cutter 328 exhibiting a reduced amount of exposure in accordance with the present invention to limit the DOC of each cutter by providing a total amount of bearing surface to disperse the WOB onto the formation being drilled. In general, larger kerfs will promote dynamic stability over formation cutting efficiency, while smaller kerfs will promote formation cutting efficiency over dynamic stability.

Furthermore, the amount of cutter exposure that each cutter is designed to have will influence how quickly, or easily, the bearing surfaces will come into contact and ride upon the formation to axially disperse the WOB being applied to the bit. That is, a relatively small amount of cutter exposure will allow the surrounding bearing surface to come into contact with the formation at a lower WOB while a relatively greater amount of cutter exposure will delay the contact of the surrounding bearing surface with the formation until a higher WOB is applied to the bit. Thus, individual cutter exposures, as well as the mean kerf widths and kerf heights may be manipulated to control the DOC of not only each cutter, but the collective DOC per revolution of the entire bit as it rotatingly engages a formation of a given hardness and confining pressure at given WOB.

Therefore, FIG. 16 illustrates an exemplary cutter profile particularly suitable for, but not limited to, a "hard formation," while FIG. 17 illustrates an exemplary cutter profile particularly suitable for, but not limited to, a "soft formation." Although the quantity of cutters provided on a bit will significantly influence the amount of kerf provided between radially adjacent cutters, it should be kept in mind that both the size, or diameter, of the cutting surfaces of the cutters may also be selected to alter the cutter profile to be more suitable for either a harder or softer formation. For example, cutters having larger diameter superabrasive tables may be utilized to provide a cutter profile including dimensionally larger kerf heights and dimensionally larger kerf widths to enhance soft formation cutting characteristics. Conversely, a bit may be provided with cutters having smaller diameter superabrasive tables to provide a cutter profile exhibiting dimensionally smaller kerf heights and dimensionally smaller kerf widths to enhance hard formation cutting characteristics of a bit in accordance with the teachings herein.

Additionally, the full-gage diameter that a bit is to have will also influence the overall cutter profile of the bit with respect to kerf heights and kerf widths, as there will be a greater total amount of bearing surface potentially available to support larger diameter bits on a formation unless the bit is provided with a proportionately greater number of reduced exposure cutters and, if desired, conventional cutters, so as to effectively reduce the total amount of potential bearing surface area of the bit.

Figure 18A:
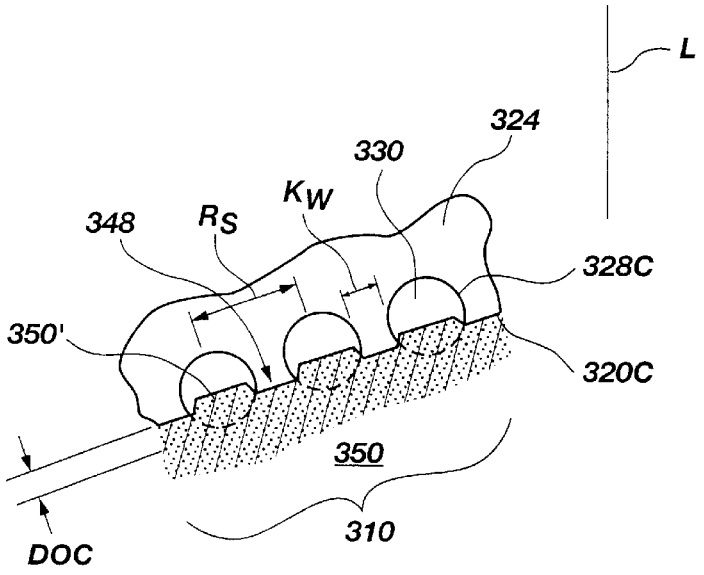
FIG. 18A is an isolated, schematic, frontal view of three representative cutters positioned in the cone region of a representative blade structure of a representative bit, each cutter is exposed at a preselected amount so as to limit the DOC of the cutters, while also providing individual kerf regions between cutters in the bearing surface of the blade in which the cutters are secured contributing to the bit's ability to ride, or rub, upon the formation when a bit embodying the present invention is in operation.

FIG. 18A of the drawings is an isolated, schematic, frontal view of three representative cutters 328C positioned in cone region 310 of a representative blade structure 308. Each of the representative cutters exhibits a preselected amount of cutter exposure so as to limit the DOC of the cutters while also providing individual kerf regions 348 between cutters 328 (in this particular illustration, kerf width $K_w$ represents the kerf width between cutters which are located on the same blade and exhibit a selected radial spacing $R_s$) and to which the bearing surface of the blade to which the cutters are secured (surface 320C) provides a bearing surface, including kerf regions 348 for the bit to ride, or rub, upon the formation, not currently being cut by this particular blade 308, upon the design WOB being exceeded for a given ROP in a formation 350 of certain hardness, or compressive strength. As can be seen in FIG. 18A, this particular view shows a rotationally leading blade surface 324 advancing toward the viewer and shows superabrasive cutting face or tables 330 of cutters 328C engaging and creating a formation cutting, or chip, 350' as the cutters engage the formation at a given DOC.

Figure 18B:
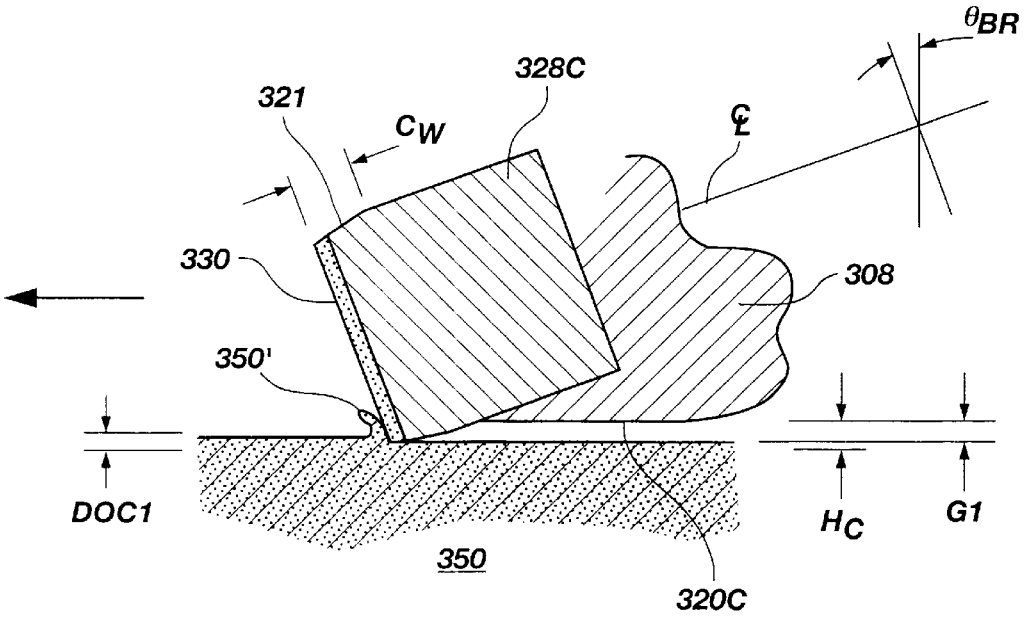
FIG. 18B is a schematic, partial side cross-sectional view of one of the cutters depicted in FIG. 18A as the cutter engages a relatively hard formation and/or engages a formation at a relatively low WOB resulting in a first, less than maximum DOC.

FIG. 18B provides an isolated, side view of a representative reduced exposure cutter, such as cutter 328C located in cone region 310. Cutter 328C is shown as being secured in a blade 308 at a preselected backrake angle $\theta_{br}$ and exhibits a selected exposed cutter height $H_c$. As can be seen in FIG. 18B, cutter 328C is provided with an optional, peripherally extending chamfered region 321 exhibiting a preselected chamfer width $C_w$. The arrow represents the intended direction of bit rotation when the bit in which the cutter is installed is placed in operation. A gap referenced as $G_1$ can be seen rotationally rearwardly of cutter 328C. Cutter exposure height $H_c$. allows a sufficient amount of cutter 328C to be exposed to allow cutter 328C to engage formation 350 at a particular DOC1, which is well within the maximum DOC that cutter 328C is capable of engaging formation 350, to create a formation cutting 350' at this particular DOC1. Thus, in accordance with the present invention, the WOB now being applied to the bit in which cutter 328C is installed, is at a value less than the design WOB for the instant ROP and the compressive strength of formation 350.

Figure 18C:
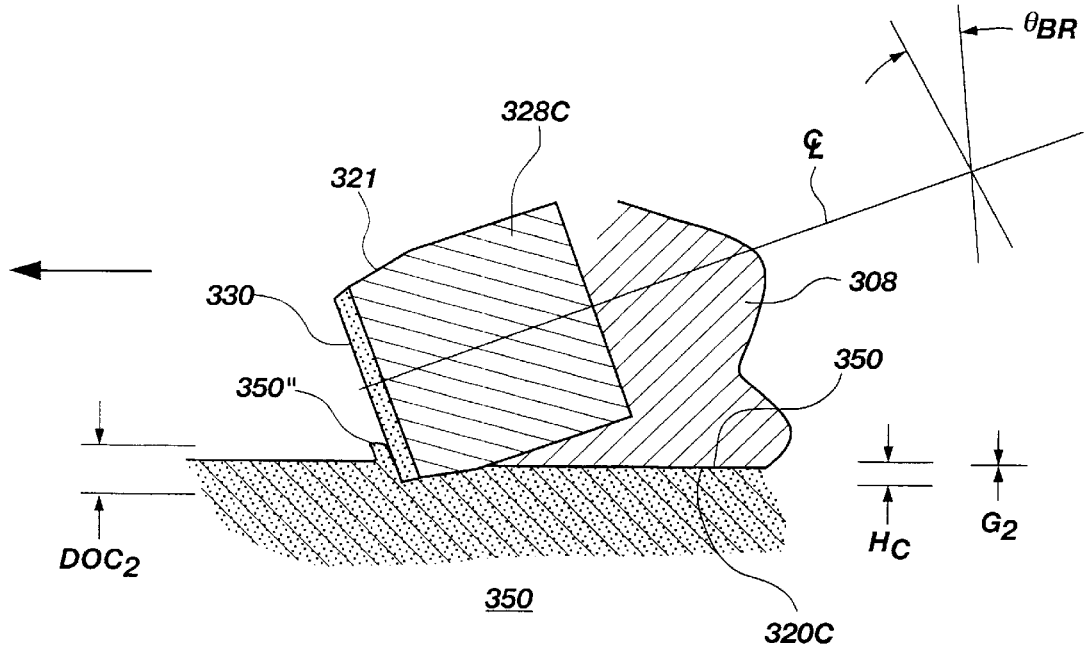
FIG. 18C is a schematic, partial side cross-sectional view of the cutter depicted in FIG. 18A as the cutter engages a relatively soft formation and/or engages a formation at relatively high WOB resulting in a second, essentially maximum DOC.

In contrast to FIG. 18B, FIG. 18C provides essentially the same side view of cutter 328C upon the design WOB for the bit being exceeded for the instant ROP and the compressive strength of formation 350. As can be seen in FIG. 18C, reduced exposure cutter 328C is now engaging formation 350 at a DOC2 which happens to be the maximum DOC that this particular cutter 328C should be allowed to cut. This is because formation 350 is now riding upon outwardly facing bearing surface 320C which generally surrounds the exposed portion of cutter 328C. That is, gap $G_2$ is essentially nil in that surface 320C and formation 350 are contacting each other and surface 320C is sliding upon formation 350 as the bit to which representative reduced exposure cutter 320C is rotated in the direction of the reference arrow. Thus, especially in the absence of optional wear knots 334, DOC2 is essentially limited to the amount of cutter exposure height $H_c$ at the presently applied WOB in light of the compressive strength of the formation being engaged at the instant ROP. Even if the amount of WOB applied to the bit to which cutter 328C is installed is increased further, DOC2 will not increase as bearing surface 320C, in addition to other face bearing surfaces 320 on the bit accommodating reduced exposure cutter 328, will prevent DOC2 from increasing beyond the maximum amount shown. Thus, bearing surface (s) 320C surrounding at least the exposed portion of cutter 328, taken collectively with other bearing surfaces, will prevent DOC2 from increasing dimensionally to an extent which could cause an unwanted, potentially bit damaging TOB being generated due to cutter 328 overengaging formation 350. That is, a maximum-sized formation cutting 350" associated with a reduced exposure cutter engaging the formation at a respective maximum DOC2, taken in combination with other reduced exposure cutters engaging the formation at a respective maximum DOC2, will not generate as taken in combination, a total, excessive amount of TOB which would stall the bit when the design WOB for the bit is met or exceeded for the particular compressive strength of the formation being engaged at the current ROP. Thus, the DOCC aspects of this particular embodiment is achieved by preferably ensuring that there is sufficient area surrounding each reduced exposure cutter 328, such as representative reduced exposure cutter 328C, so that not only is the DOC2 for this particular cutter not exceeded, regardless of the WOB being applied, but preferably the DOC of a sufficient number of other cutters provided along the face of a bit encompassing the present invention is limited to an extent which prevents an unwanted, potentially damaging TOB from being generated. Therefore, it is not necessary that each and every cutter provided on a drill bit exhibit a reduced exposure cutter height so as to effectively limit the DOC of each and every cutter, but it is preferred that at least a sufficient quantity of cutters of the total quantity of cutters provided on a bit be provided with at least one of the DOCC features disclosed herein to preclude a bit, and the cutters thereon, from being exposed to a potentially damaging TOB in light of the ROP for the particular formation being drilled. For example, limiting the amount of cutter exposure of each cutter positioned in the cone region of a drill bit may be sufficient to prevent an unwanted amount of TOB should the WOB exceed the design WOB when drilling through a formation of a particular hardness at a particular ROP.

FIGS. 19–22 are graphical portrayals of laboratory test results of four different bladed-style drill bits incorporating PDC cutters on the blades thereof Drill bits "RE-S" and "RE-W" each had selectively reduced cutter exposures in accordance with the present invention as previously described and illustrated in FIGS. 14A–18C. However, bit "RE-S" was provided with a cutter profile exhibiting small kerfs and "RE-W" was provided with a cutter profile exhibiting wide kerfs. The bits having reduced exposure cutters are graphically contrasted with the laboratory test results of a prior art steerable bit "STR" featuring approximately 0.50 inch diameter cutters with each cutter including a superabrasive table having a peripheral edge chamfer exhibiting a width of approximately 0.050 inches and angled toward the longitudinal axis of the cutter by approximately 45°. Conventional, or standard, general purpose drill bit "STD" featured approximately 0.50 inch diameter cutters backraked at approximately 20° and exhibiting chamfers that were approximately 0.016 inches in width and angled approximately 45° with respect to the longitudinal axis of the cutter. All bits had a gage diameter of approximately 12.25 inches and were rotated at 120 RPM during testing. With respect to all of the tested bits, the PDC cutters installed in the cone, nose, flank, and shoulder of the bits had cutter backrake angles of approximately 20°0 and the PDC cutters installed generally within the gage region had a cutter backrake angle of approximately 30°. The cutter exposure heights of the RE-S and RE-W bits were approximately 0.120 inches for the cutters positioned in the cone region, approximately 0.150 inches in the nose region, approximately 0.100 inches in the flank region, approximately 0.063 inches in the shoulder region, and the cutters in the gage region were generally ground flush with the gage for both of these bits embodying the present invention. The PDC cutters of the RE-S and RE-W bits were approximately 0.75 inches in diameter (with the exception of PDC cutters located in the gage region which were smaller diameter and ground flush with the gage) and were provided with a chamfer on the peripheral edge of the superabrasive cutting table of the cutter. The chamfers exhibited a width of approximately 0.019 inches and were angled toward the longitudinal axes of the cutters by approximately 45°. The mean kerf width of the RE-S bit was approximately 0.3 of an inch and the mean kerf width of the RE-W bit was approximately 0.2 an inch.

Figure 19:
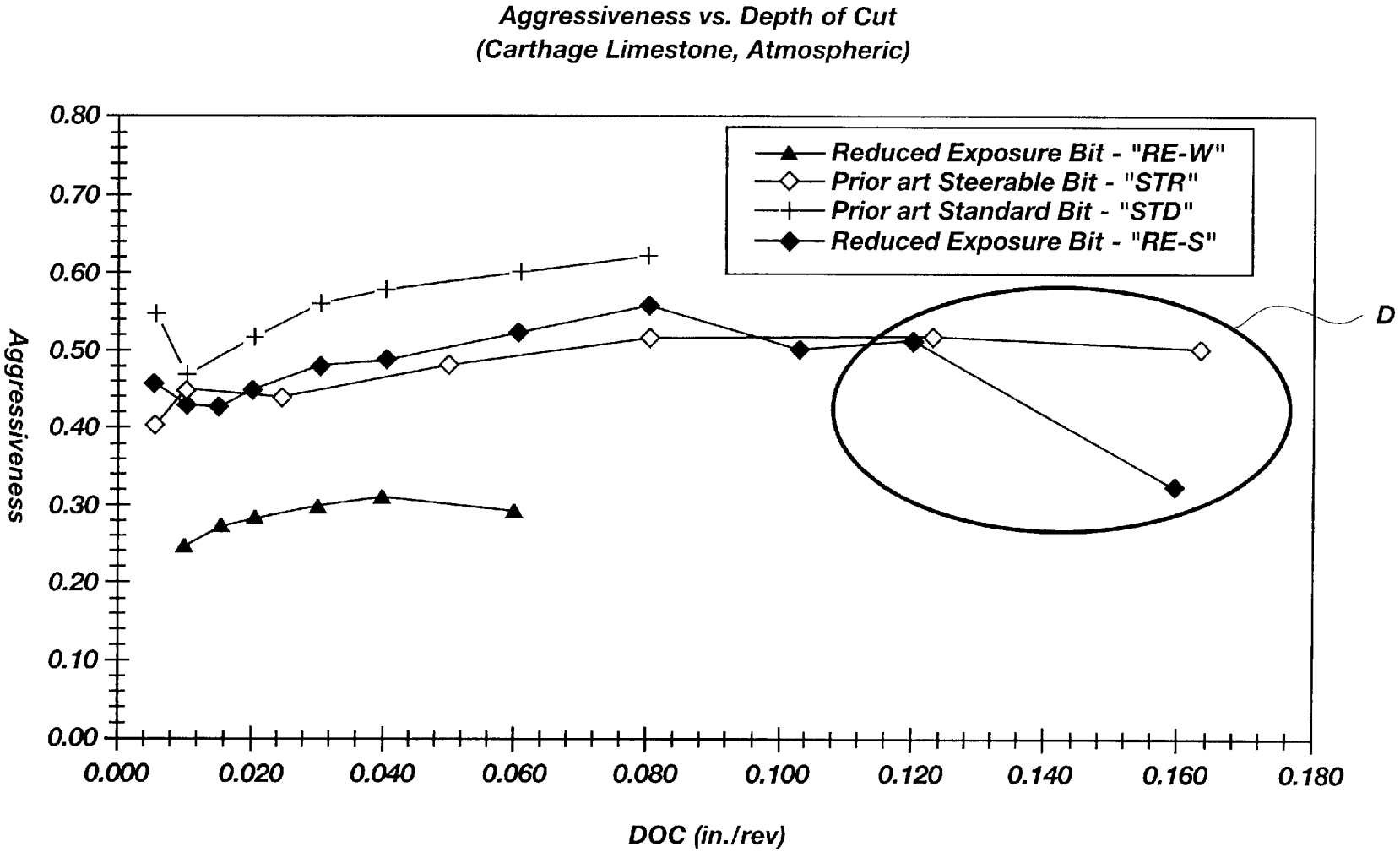
FIG. 19 is a graph depicting laboratory test results of Aggressiveness versus DOC for a representative prior art steerable bit (STR bit), a conventional, or standard, general purpose bit (STD bit) and two exemplary bits embodying the present invention (RE-W and RE-S) as tested in a Carthage limestone formation at atmospheric pressure.

FIG. 19 depicts test results of Aggressiveness ($\mu$) vs. DOC (in/rev)of the four different drill bits. Aggressiveness ($\mu$), which is defined as Torque/(Bit Diameter×Thrust), can be expressed as:

$$\mu = 36\text{Torque (ft-lbs)/WOB(lbs)}\cdot\text{Bit Diameter(inches)}$$

The values of DOC depicted in FIG. 19 represent the DOC measured in inches of penetration per revolution that the test bits made in the test formation of Carthage limestone. The confining pressure of the formation in which the bits were tested was at atmospheric, or in other words 0 psig.

Of significance is the encircled region "D" of the graph of FIG. 19. The plot of bit RE-S prior to encircled region D is very similar in slope to prior art steerable bit STR but upon the DOC reaching about 0.120 inches, the respective aggressiveness of the RE-S bit falls rather dramatically compared to the plot of the STR bit proximate and within encircled region D. This is attributable to the bearing surfaces of the RE-S bit taking on and axially dispersing the elevated WOB upon the formation axially underlying the bit associated with the larger DOCs, such as the DOCs exceeding approximately 0.120 inches in accordance with the present invention.

Figure 20:
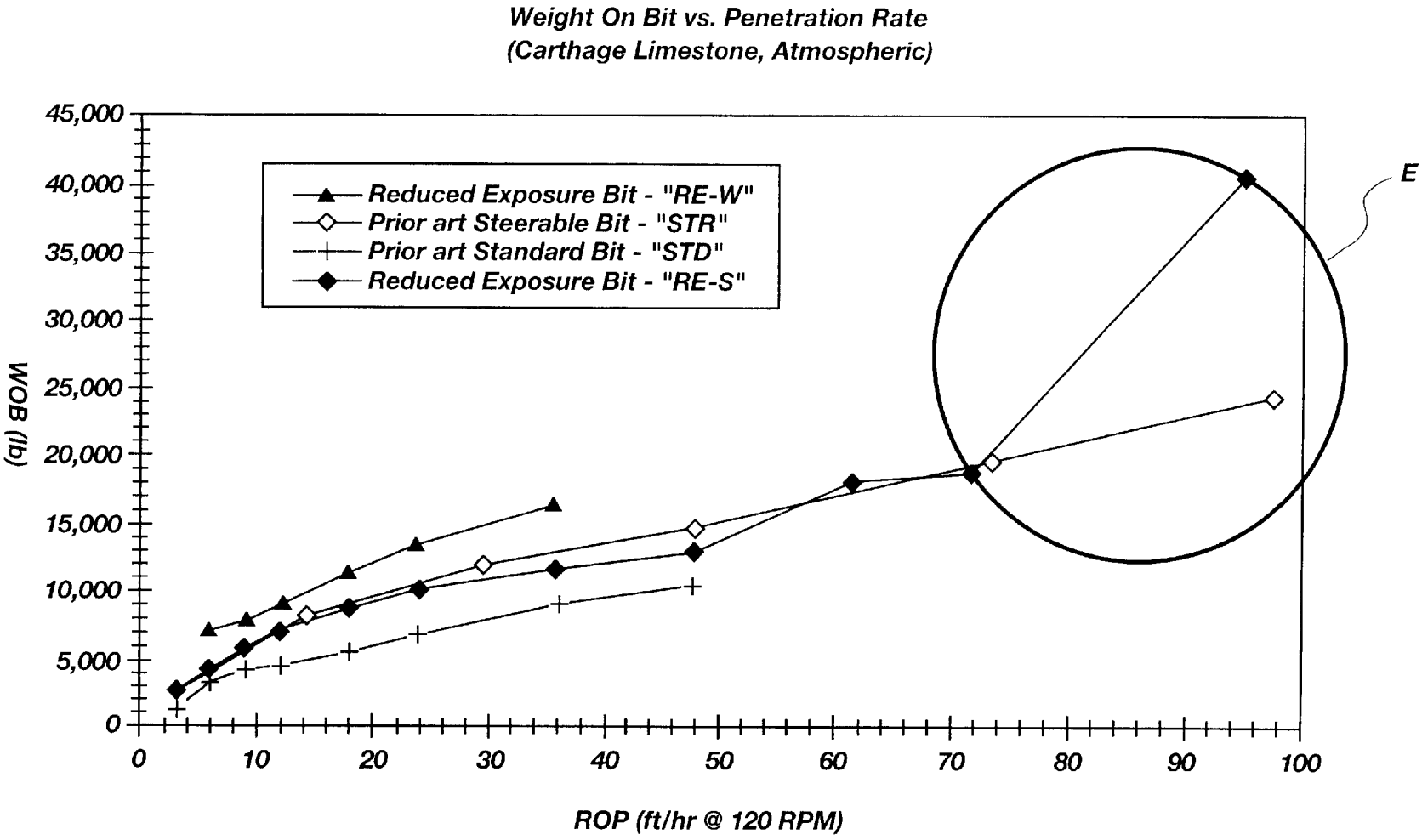
FIG. 20 is a graph depicting laboratory test results of WOB versus ROP for the tested bits.

FIG. 20 graphically portrays the test results with respect to WOB in pounds versus ROP in feet per hour with a drill bit rotation of 120 revolutions per minute. Of general importance in the graph of FIG. 20 is that all of the plots tend to have the same flat curve as WOB and ROP increases indicating that at lower WOBs and lower ROPs of the RE-S and RE-W bits embodying the present invention exhibit generally the same behavior as the STR and STD bits. However, as WOB was increased, the RE-S bit in particular required an extremely high amount of WOB in order to increase the ROP for the bit due to the bearing surfaces of the bit taking on and dispersing the axial loading of the bit. This is evidenced by the plot of the reduced cutter exposure bit in the vicinity of region "E" of the graph exhibiting a dramatic upward slope. Thus, in order to increase the ROP of the subject inventive bit at ROP values exceeding about 75 ft/hr, a very significant increase of WOB was required for WOB values above approximately 20,000 lbs as the load on the subject bit was successfully dispersed on the formation axially underlying the bit. The fact that a WOB of approximately 40,000 lbs was applied without the RE-S bit stalling provides very strong evidence of the effectiveness of incorporating reduced exposure cutters to modulate and control TOB in accordance with the present invention as will become even more apparent in yet to be discussed FIG. 22.

Figure 21:
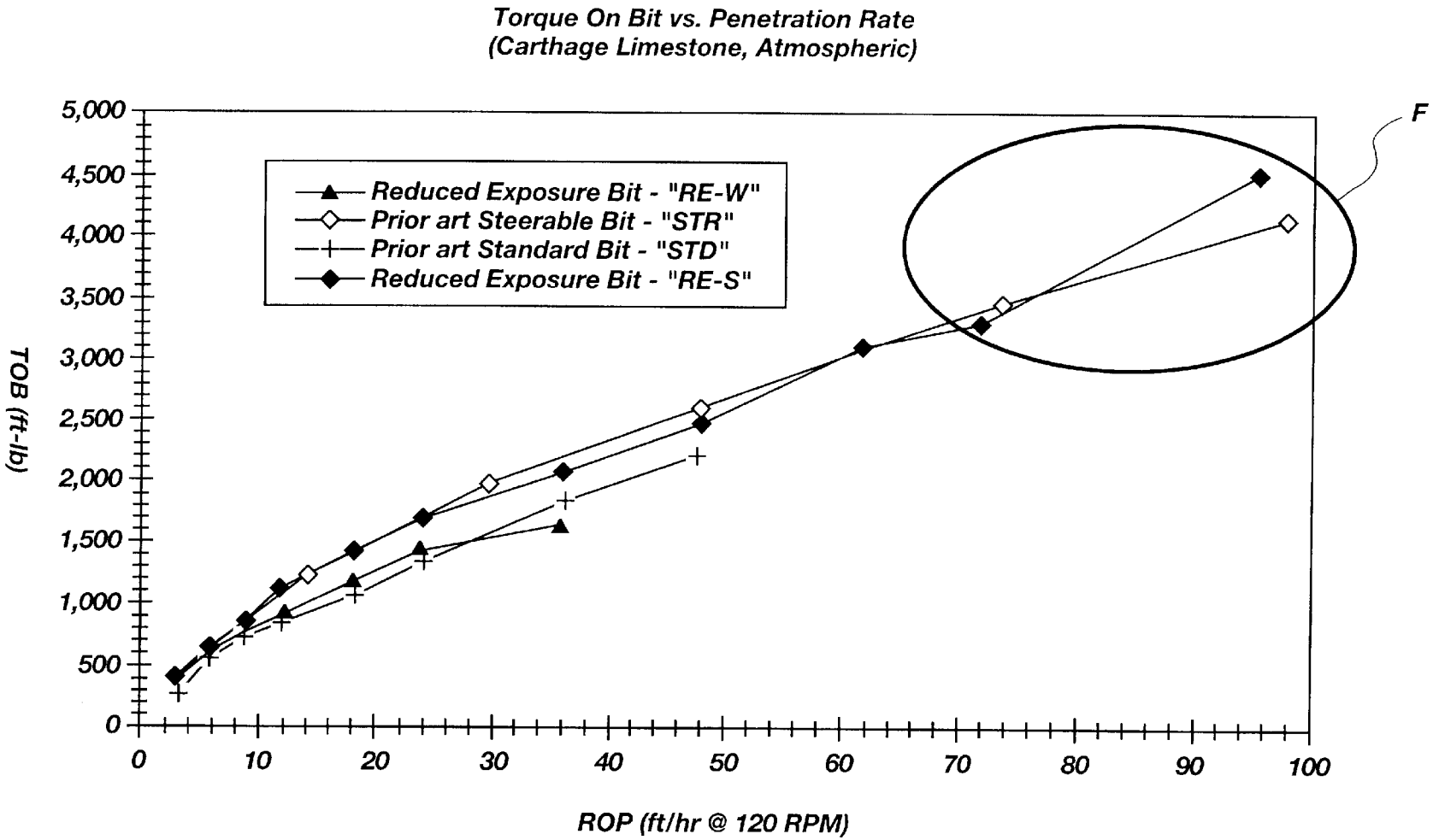
FIG. 21 is a graph depicting laboratory test results of TOB versus ROP for the tested bits.

FIG. 21 is a graphical portrayal of the test results in terms of TOB in the units of pounds-foot versus ROP in the units of feet per hour. As can be seen in the graph of FIG. 21 the various plots of the tested bits generally tracked the same, moderate and linear slope throughout the respective extent of each plot. Even in region "F" of the graph, where ROP was over 80 ft/hr, the TOB curve of the bit having reduced exposure cutters exhibited only slightly more TOB as compared to the prior art steerable and standard, general purpose bit notwithstanding the corresponding highly elevated WOB being applied to the subject inventive bit as shown in FIG. 20.

Figure 22:
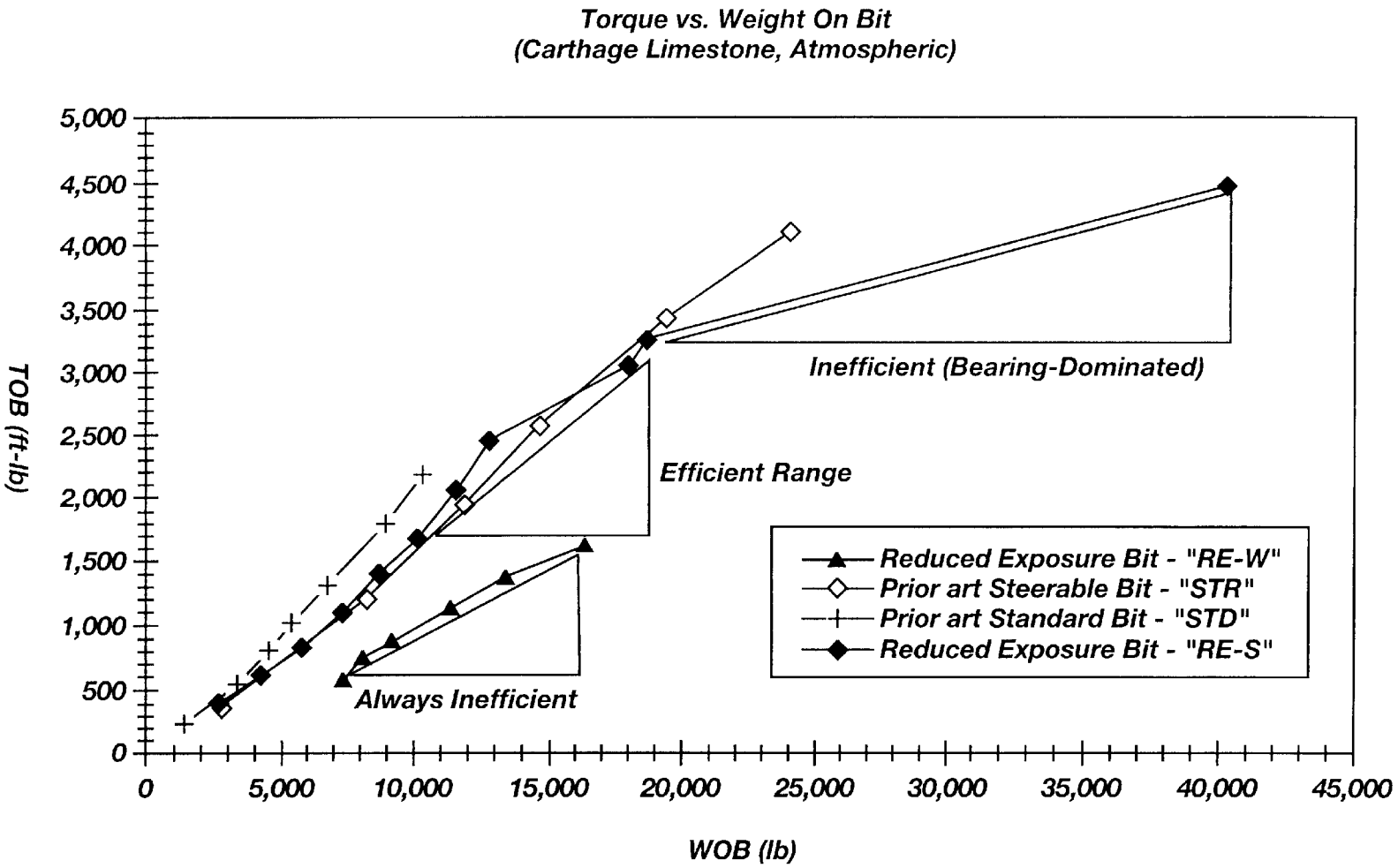
FIG. 22 is a graph depicting laboratory test results of TOB versus WOB for the tested bits.

FIG. 22 is a graphical portrayal of the test results in terms of TOB in the units of foot-pounds versus WOB in the units of pounds. Of particular significance with respect to the graphical data presented in FIG. 22 is that the STD bit provides a high degree of aggressivity at the expense of generating a relatively high amount of TOB at lower WOBs. Thus, if a generally non-steerable, standard bit were to suddenly "break through" a relative hard formation into a relatively soft formation, or if WOB were suddenly increased for some reason, the attendant high TOB generated by the highly aggressive nature of such a conventional bit would potentially stall and/or damage the bit.

The representative prior art steerable bit generally has an efficient TOB/WOB slope at WOB's below approximately 20,000 lbs but at WOBs exceeding approximately 20,000 lbs, the attendant TOB is unacceptably high and could lead to unwanted bit stalling and/or damage. The RE-W bit incorporating the reduced exposure cutters in accordance with the present invention, which also incorporated a cutter profile having large kerf widths so that the onset of the bearing surfaces of the bit contacting the formation occurs at relatively low values of WOB. However, the bit having such an "always rubbing the formation" characteristic via the bearing surfaces, such as formation facing surfaces 320 of blades 308 as previously discussed and illustrated herein, coming into contact and axially dispersing the applied WOB upon the formation at relatively low WOBs, may provide acceptable ROPs in soft formations, but such a bit would lack the amount of aggressivity needed to provide suitable ROPs in harder, firmer formations and thus could be generally considered to exhibit an inefficient TOB versus WOB curve.

The representative RE-S bit incorporating reduced exposure cutters of the present invention and exhibiting relatively small kerf widths effectively delayed the bearing surfaces (for example, including but not limited to surface 320 of blades 308 as previously discussed and illustrated herein) surrounding the cutters from contacting the formation until relatively higher WOBs were applied to the bit. This particularly desirable characteristic is evidenced by the plot for the RE-S bit at WOB values greater than approximately 20,000 lbs exhibits a relatively flat and linear slope as the WOB is approximately doubled to 40,000 lbs with the resulting TOB only increasing by about 25% from a value of about 3,250 ft-lbs to a value of approximately 4,500 ft-lbs. Thus, considering the entire plot for the subject inventive bit over the depicted range of WOB, the RE-S bit is aggressive enough to efficiently penetrate firmer formations at a relatively high ROP, but if WOB should be increased, such as by loss of control of the applied WOB, or upon breaking through from a hard formation into a softer formation, the bearing surfaces of the bit contact the formation in accordance with the present invention to limit the DOC of the bit as well as to modulate the resulting TOB so as to prevent stalling of the bit. Because stalling of the bit is prevented, the unwanted occurrence of losing tool face control or worse, damage to the bit is minimized if not entirely prevented in many situations.

It can now be appreciated that the present invention is particularly suitable for applications involving extended reach or horizontal drilling where control of WOB becomes very problematic due to friction-induced drag on the bit, downhole motor if being utilized, and at least a portion of the drill string, particularly that portion of the drill string within the extended reach, or horizontal, section of the borehole being drilled. In the case of conventional, general purpose fixed cutter bits, or even when using prior art bits designed to have enhanced steerability, which exhibit high efficiency, that is, the ability to provide a high ROP at a relatively low WOB, the bit will be especially prone to large magnitudes of WOB fluctuation, which can vary from 10 to 20 klbs (10,000 to 20,000 pounds) or more, as the bit lurches forward after overcoming a particularly troublesome amount of frictional drag. The accompanying spikes in TOB resulting from the sudden increase in WOB may in many cases be enough to stall a downhole motor or damage a high efficient drill bit and or attached drill string when using a conventional drill string driven by a less sophisticated conventional drilling rig. If a bit exhibiting a low efficiency is used, that is, a bit that requires a relatively high WOB is applied to render a suitable ROP, the bit may not be able to provide a fast enough ROP when drilling harder, firmer formations. Therefore, when practicing the present invention of providing a bit having a limited amount of cutter exposure above the surrounding bearing surface of the bit and selecting a cutter profile which will provide a suitable kerf width and kerf height, a bit embodying the present invention will optimally have a high enough efficiency to drill hard formations at low depths-of-cut but exhibit a torque ceiling that will not be exceeded in soft formations when WOB surges.

While the present invention has been described herein with respect to certain preferred embodiments, those of ordinary skill in the art will recognize and appreciate that it is not so limited and many additions, deletions, and modifications to the preferred embodiments may be made without departing from the scope of the invention as claimed. In addition, features from one embodiment may be combined with features of another embodiment while still being encompassed within the scope of the invention. Further, the invention has utility in both full bore bits and core bits, and with different and various bit profiles as well as cutter types, configurations and mounting approaches.

What is claimed is:

1. A drill bit for subterranean drilling, comprising:

a bit body including a longitudinal centerline, a leading end having a face for contacting a formation having a maximum compressive strength during drilling, and a trailing end having a structure associated therewith for connecting the bit body to a drill string, the face of the leading end configured to include a total bearing surface of a size sufficient to substantially support the bit body upon the bit body being forced against the formation at a maximum weight-on-bit resulting in a unit load on the formation not exceeding the maximum compressive strength of the formation; and at least one superabrasive cutter for engaging the formation during drilling secured to a selected portion of the face of the leading end of the bit body, the at least one superabrasive cutter exhibiting a limited amount of cutter exposure perpendicular to the selected portion of the face of the leading end to which the at least one superabrasive cutter is secured to, in combination with the total bearing surface of the bit body, limit a maximum depth-of-cut of the at least one superabrasive cutter into the formation having the maximum compressive strength during drilling.

2. The drill bit of claim 1, wherein the at least one superabrasive cutter comprises a plurality of superabrasive cutters and the face of the leading end comprises a plurality of blade structures protruding from the bit body, at least some of the plurality of blade structures carrying at least one of the plurality of superabrasive cutters and the blade structures exhibiting in total a combined bearing surface area of sufficient size to maintain the unit load on the formation not exceeding the maximum compressive strength thereof.

3. The drill bit of claim 2, wherein the at least some of the plurality of blade structures each extend from a respective point generally proximate the longitudinal centerline of the bit body generally radially outward toward a gage of the bit body and longitudinally toward the trailing end of the bit body.

4. The drill bit of claim 3, wherein the at least some of the plurality of blade structures each carry several of the plurality of superabrasive cutters and exhibit at least one bearing surface, and wherein each of the plurality of blade structures generally encompasses each of the several of the plurality of superabrasive cutters carried thereon with a limited portion of each of the several superabrasive cutters exposed by a preselected extent perpendicular from the respective at least one bearing surface proximate each of the several superabrasive cutters so as to control a respective depth-of-cut for each of the several superabrasive cutters.

5. The drill bit of claim 2, wherein the bit body comprises at least one of steel and a metal matrix.

6. The drill bit of claim 4, wherein at least a portion of the at least one bearing surface of at least one of the plurality of blade structures includes a wear-resistant exterior.

7. The drill bit of claim 4, wherein the bit body comprises steel and the at least one bearing surface of at least one of the plurality of blade structures includes an exterior hard facing.

8. The drill bit of claim 7, wherein the exterior hard facing comprises tungsten carbide particles.

9. The drill bit of claim 2, wherein at least one bearing surface of at least one of the plurality of blade structures comprises a wear-resistant exterior.

10. The drill bit of claim 4, wherein the at least one bearing surface is built up with a hard facing on at least a portion thereof substantially surrounding at least one of the plurality of superabrasive cutters so as to effectively limit an amount of exposure of the at least one of the superabrasive cutters.

11. The drill bit of claim 9, wherein the wear-resistant exterior comprises at least one of the group consisting of carbide, tungsten carbide, synthetic diamond, natural diamond, polycrystalline diamond, thermally stable polycrystalline diamond, cubic boron nitride, and hard facing material.

12. The drill bit of claim 4, wherein the face of the leading end of the bit body comprises a cone, nose, flank, shoulder, and gage region.

13. The drill bit of claim 12, wherein at least one of the plurality of superabrasive cutters is positioned in the cone region and exhibits a lesser amount of cutter exposure than at least one other of the plurality of superabrasive cutters positioned in the nose region.

14. The drill bit of claim 13, wherein the at least one other superabrasive cutter positioned in the nose region exhibits a greater amount of cutter exposure than the at least one superabrasive cutter positioned in the cone region.

15. The drill bit of claim 14, wherein at least one of the plurality of superabrasive cutters is positioned in the flank region and exhibits a lesser amount of cutter exposure than the at least one superabrasive cutter positioned in the cone region.

16. The drill bit of claim 15, wherein at least one of the plurality of superabrasive cutters is positioned in the shoulder region and exhibits a lesser amount of cutter exposure than the at least one superabrasive cutter positioned in the flank region.

17. The drill bit of claim 16, wherein the cutter exposure of the at least one superabrasive cutter in the nose region does not exceed approximately 0.2 inch.

18. The drill bit of claim 16, wherein the cutter exposure of the at least one superabrasive cutter in the nose region does not exceed approximately 0.16 inch.

19. The drill bit of claim 18, wherein the cutter exposure of the at least one superabrasive cutter in the cone region does not exceed approximately 0.13 inch, the cutter exposure of the at least one superabrasive cutter in the flank region does not exceed approximately 0.1 inch, and the cutter exposure of the at least one superabrasive cutter in the shoulder region does not exceed approximately 0.07 inch.

20. The drill bit of claim 4, wherein the plurality of superabrasive cutters is positioned to have a cutter-to-cutter radial overlap profile defining at least one kerf region located between mutually, radially adjacent superabrasive cutters.

21. The drill bit of claim 4, wherein the plurality of superabrasive cutters is positioned to have a cutter-to-cutter radial overlap profile allowing exposed portions of the plurality of superabrasive cutters to substantially and essentially continuously axially support the drill bit in formations under a variety of weight-on-bit loads and a variety of rate-of-penetrations.

22. The drill bit of claim 20, wherein the cutter-to-cutter radial overlap profile comprises a plurality of kerf regions respectively positioned radially between adjacently positioned individual cutter profiles, each of the plurality of kerf regions having a kerf width ranging from approximately 0.01 of an inch to approximately 0.75 of an inch and a kerf height ranging from approximately 0.01 of an inch to approximately 0.5 of an inch.

23. The drill bit of claim 20, wherein the cutter-to-cutter radial overlap profile comprises a plurality of kerf regions respectively positioned radially between adjacently positioned individual cutter profiles, each of the plurality of kerf regions having a kerf height approximately equal to an amount of exposure to which cutters respectively associated with the adjacently positioned individual cutter profiles are exposed by a preselected extent perpendicular from the respective at least one bearing surface proximate each of the plurality of superabrasive cutters.

24. The drill bit of claim 2, wherein at least one superabrasive cutter of the plurality comprises a chamfered region extending at least partially about a circumferential periphery thereof.

25. The drill bit of claim 3, wherein at least one superabrasive cutter of the plurality includes an effective backrake angle not exceeding approximately 20° with respect to an intended direction of drill bit rotation perpendicular to the formation to be engaged by the at least one superabrasive cutter of the plurality.

26. The drill bit of claim 25, further comprising a superabrasive cutter of the plurality positioned and secured to the bit body in a gage region of the drill bit and having an effective backrake angle substantially exceeding approximately 20°.

27. The drill bit of claim 25, wherein the at least one superabrasive cutters further includes a superabrasive backrake angle of approximately 30°.

28. The drill bit of claim 4, wherein at least one wear knot structure is disposed upon the at least one bearing surface proximate at least one superabrasive cutter of the plurality, the at least one wear knot structure exhibiting a radially outermost wear knot surface that is generally inset a preselected distance from a rotational profile exhibited by an outermost portion of an exposed portion of at least one rotationally associated superabrasive cutter upon the drill bit being rotated.

29. The drill bit of claim 28, wherein the at least one wear knot structure comprises a plurality of wear knot structures and the preselected distance that the radially outermost wear knot surface of each of the plurality of wear knot structures is inset from the rotational profile exhibited by the outermost portion of the exposed portion of the at least one rotationally associated superabrasive cutter ranges from approximately 0.05 of an inch to approximately 0.2 of an inch.

30. The drill bit of claim 1, wherein the at least one superabrasive cutter comprises a chamfered peripheral edge portion of a preselected width and chamfer angle.

31. The drill bit of claim 1, wherein the at least one superabrasive cutter comprises a plurality of superabrasive cutters, each exhibiting a generally equal amount of cutter exposure perpendicular to the selected portion of the face of the leading end to which each of the plurality of superabrasive cutters is secured.

32. The drill bit claim 1, wherein the at least one superabrasive cutter comprises a plurality of superabrasive cutters, each exhibiting generally differing amounts of cutter exposure perpendicular to the selected portion of the face of the leading end to which each of the plurality of superabrasive cutters is secured.

33. A method of drilling a subterranean formation without generating an excessive amount of torque-on-bit, comprising:

engaging the formation with at least one cutter of a drill bit within a selected depth-of-cut range; and limiting a maximum depth-of-cut of the at least one cutter during application of a weight-on-bit in excess of that required for the at least one cutter to penetrate the formation within the selected depth-of-cut range.

34. The method of claim 33, further comprising limiting the maximum depth-of-cut of the at least one cutter during application of the excess weight-on-bit by providing at least one formation-facing bearing surface on the drill bit generally surrounding at least a portion of the at least one cutter and limiting an extent of exposure of the at least one cutter generally perpendicular to the at least one formation-facing bearing surface.

35. The method of claim 34, further comprising maintaining the maximum depth-of-cut of the at least one cutter under the excess weight-on-bit by providing a total formation-facing bearing area on the drill bit sufficient to axially support the drill bit on the formation without substantial failure of the formation axially underlying the drill bit.

36. The method of claim 35, further comprising maintaining the selected depth-of-cut range under the excess weight-on-bit by supporting the drill bit on the formation without precipitating substantial plastic deformation thereof.

37. The method of claim 34, further comprising:

applying a selected weight to cause the at least one cutter of the drill bit to engage the formation to a selected depth of cut; and precluding subsequent penetration of the at least one cutter into the formation in excess of the selected depth of cut during application of a weight-on-bit greater than the selected weight.

38. The method of claim 37, further comprising maintaining the selected depth of cut under the greater weight-on-bit by providing a bearing area on the drill bit to distribute the greater weight-on-bit sufficient to achieve a unit load by the bearing area on the formation less than a compressive strength of the formation.

39. The method of claim 33, wherein limiting the maximum depth-of-cut of the at least one cutter comprises limiting the maximum depth-of-cut of a plurality of superabrasive cutters, each being limited to generally an equal amount of cutter exposure perpendicular to a selected portion of an outward face of a leading end to which each of the plurality of superabrasive cutters is secured.

40. The method of claim 33, wherein limiting the maximum depth-of-cut of the at least one cutter comprises limiting the maximum depth-of-cut of a plurality of superabrasive cutters, each being limited to generally differing amounts of cutter exposure perpendicular to a selected portion of an outward face of a leading end to which each of the plurality of superabrasive cutters is secured.

41. The method of claim 33, further comprising:

applying a first selected weight-on-bit to cause the at least one cutter to engage a first formation to a first selected depth-of-cut;

precluding subsequent penetration of the at least one cutter into the first formation in excess of the maximum depth-of-cut during application of an excessive weight-on-bit exceeding the first selected weight-on-bit;

applying a second selected weight-on-bit different from the first selected weight-on-bit to cause the at least one cutter to engage a second formation to a second selected depth-of-cut different from the first selected depth-of-cut; and precluding subsequent penetration of the at least one cutter into the second formation in excess of the maximum depth-of-cut during application of an excessive weight-on-bit exceeding the second selected weight-on-bit.

42. The method of claim 34, wherein limiting the maximum depth-of-cut of the at least one cutter during application of the excess weight-on-bit by providing the at least one formation-facing bearing surface generally surrounding the at least a portion of the at least one cutter and limiting the extent of exposure of the at least one cutter generally perpendicular to the at least one formation-facing bearing surface comprises limiting a maximum depth-of-cut of a plurality of superabrasive cutters and wherein several of the plurality of superabrasive cutters are respectively secured to a plurality of blade structures extending radially outwardly from a longitudinal axis of the drill bit generally toward a gage region of the drill bit.

43. The method of claim 42, wherein limiting the maximum depth-of-cut of the plurality of superabrasive cutters comprises respectively limiting the extent of exposure of each of the plurality of superabrasive cutters perpendicular to the respective at least one formation-facing bearing surface proximate each of the plurality of superabrasive cutters to a selected cutter exposure height.

44. The method of claim 43, wherein limiting the maximum depth-of-cut of the plurality of superabrasive cutters comprises respectively limiting the extent of exposure of each of the plurality of superabrasive cutters perpendicular to the respective at least one formation-facing bearing surface proximate each of the plurality of superabrasive cutters to a cutter exposure height not to exceed approximately 0.15 inch.

45. The method of claim 43, wherein limiting the maximum depth-of-cut of the plurality of superabrasive cutters comprises respectively limiting the extent of exposure of each of the plurality of superabrasive cutters perpendicular to the respective at least one formation-facing bearing surface proximate each of the plurality of superabrasive cutters located in a crown region of the drill bit to a cutter exposure height not to exceed approximately 0.12 inch.

46. The method of claim 45, wherein limiting the maximum depth-of-cut of the plurality of superabrasive cutters comprises limiting the extent of exposure of at least one superabrasive cutter of the plurality located in a nose region to a cutter exposure height not to exceed approximately 0.15 inch, limiting the extent of exposure of at least one superabrasive cutter of the plurality located in a flank region to cutter exposure height not to exceed approximately 0.10 inches, and limiting the extent of exposure of at least one superabrasive cutter of the plurality located in a shoulder region to a cutter exposure height not to exceed approximately 0.063 inch.

47. The method of claim 43, wherein limiting the maximum depth-of-cut of the plurality of superabrasive cutters comprises respectively limiting the extent of exposure of each of the plurality of superabrasive cutters perpendicular to the respective at least one formation-facing bearing surface proximate each of the plurality of superabrasive cutters to the selected cutter exposure height comprises providing at least one wear knot rotationally following at least one of the superabrasive cutters having the selected cutter exposure height to augment the limiting of the maximum depth-of-cut of the at least one cutter.

48. The method of claim 47, wherein providing the at least one wear knot comprises providing a plurality of wear knots on the formation-facing bearing surfaces.

49. The method of claim 48, wherein providing the plurality of wear knots on the formation-facing bearing surfaces comprises providing a plurality of wear knots on formation-facing bearing surfaces respectively located on the plurality of blade structures.

50. The method of claim 43, wherein respectively limiting the extent of exposure of each of the plurality of superabrasive cutters perpendicular to the respective at least one formation-facing bearing surface proximate each of the plurality of superabrasive cutters to the selected cutter exposure height comprises applying a hard facing material to build up a selected portion of the respective at least one formation-facing bearing surface proximate at least one of the superabrasive cutters so as to further limit the extent of exposure of the at least one of the superabrasive cutters.

51. The method of claim 50, wherein applying the hard facing material to build up the respective at least one formation-facing bearing surface comprises applying the hard facing material to a steel-bodied bit.

52. The method of claim 51, wherein applying the hard facing material to the steel-bodied bit comprises applying the hard facing material within at least a cone region of the steel-bodied bit.

53. The method of claim 41, wherein limiting the maximum depth-of-cut of the at least one cutter comprises limiting a maximum depth-of-cut of a plurality of superabrasive cutters, each being limited to generally an equal amount of cutter exposure perpendicular to a selected portion of an outward face of a leading end to which each of the plurality of superabrasive cutters is secured.

54. The method of claim 41, wherein limiting the maximum depth-of-cut of the at least one cutter comprises limiting the maximum depth-of-cut of a plurality of superabrasive cutters, each being limited to generally differing amounts of cutter exposure perpendicular to a selected portion of an outward face of a leading end to which each of the plurality of superabrasive cutters is secured.

55. A method of designing a drill bit for drilling subterranean formations, the drill bit under design including a plurality of superabrasive cutters disposed about the formation-engaging leading end of the drill bit, the method comprising:

selecting a maximum depth-of-cut for the at least some of the plurality of superabrasive cutters;

selecting a cutter profile arrangement to which the at least some of the plurality of superabrasive cutters are to be radially and longitudinally positioned on the leading end of the drill bit;

selecting an individual extent of cutter exposure to which the at least some of the plurality of superabrasive cutters are to be exposed generally perpendicular from at least one respective formation-facing bearing surface at least partially surrounding the at least some of the plurality of superabrasive cutters so as to ensure that the selected maximum depth-of-cut for the at least some of the plurality of superabrasive cutters is not exceeded; and including within the design of the drill bit a sufficient total amount of formation-facing bearing surface area to axially support the drill bit should the drill bit be subjected to a weight-on-bit exceeding a weight-on-bit which would cause the at least some of the plurality of superabrasive cutters to engage a subterranean formation at the selected maximum depth-of-cut.

56. The method of claim 55, further comprising determining for at least one type of subterranean formation a first amount of weight-on-bit that will generate an associated amount of torque-on-bit to which the at least some of the plurality of superabrasive cutters to be radially and longitudinally positioned on the leading end of the drill bit will axially support the drill bit without the at least one respective formation-facing bearing surface substantially contacting subterranean formation.

57. The method of claim 55, further comprising including within the drill bit under design a plurality of kerf regions of a preselected width positioned laterally intermediate of selected rotationally adjacently positioned superabrasive cutters.

58. The method of claim 55, wherein selecting the individual extent of cutter exposure to which the at least some of the plurality of superabrasive cutters are to be exposed comprises selecting an individual extent of cutter exposure to which the at least some of the plurality of superabrasive cutters are to be exposed that is at least partially dependent upon a particular region of the drill bit to which each of the at least some of the plurality of superabrasive cutters is to be positioned.

59. The method of claim 58, wherein selecting the individual extent to which the at least some of the plurality of superabrasive cutters are to be exposed comprises selecting at least one individual extent of cutter exposure for at least one superabrasive cutter of the plurality to be respectively located in at least one of a cone region, a nose region, a flank region, and a shoulder region of the drill bit.

60. The method of claim 59, further comprising selecting a quantity of wear knots to be respectively positioned on the drill bit so at to rotationally follow at least some of the plurality of superabrasive cutters.

61. The method of claim 58, wherein selecting the individual extent to which the at least some of the plurality of superabrasive cutters are to be exposed comprises selecting an amount of hard facing to be disposed on at least a portion of the at least one respective formation-facing bearing surface at least partially surrounding the at least some of the plurality of superabrasive cutters.

62. The method of claim 55, wherein selecting the individual extent of cutter exposure to which the at least some of the plurality of superabrasive cutters are to be exposed comprises generally selecting an individual extent of cutter exposure for each of the plurality of superabrasive cutters to be the same amount.

63. The method of claim 55, wherein selecting the individual extent of cutter exposure to which the at least some of the plurality of superabrasive cutters are to be exposed comprises generally selecting an individual extent of cutter exposure for each of the plurality of superabrasive cutters to be a mutually different amount.

64. A rotary drag bit for drilling subterranean formations comprising:

a bit body having a longitudinal axis and extending radially outward therefrom to a gage, the bit body further comprising at least a first region and a second region over a face to be oriented toward at least one subterranean formation during drilling; and a plurality of cutters secured on the bit body in the first and second regions, at least one of the plurality of cutters having a superabrasive cutting face having a preselected geometry and being positioned substantially transverse to a direction of cutter movement during drilling, and wherein the at least one cutter exhibits a limited amount of cutter exposure perpendicular to a portion of the formation-facing surface to which the at least one cutter is secured to control a maximum depth-of-cut of the at least one cutter into the formation during drilling.

65. The rotary drag bit of claim 64, wherein the first region comprises an area closer to the longitudinal axis of the bit body than the second region and the at least one cutter is located in the first region.

66. The rotary drag bit of claim 65, wherein the first region is a cone region on the face of the bit body and the at least one cutter secured to the formation-facing surface is located on a blade structure.

67. The rotary drag bit of claim 66, wherein the at least one cutter is a plurality of cutters respectively secured to a plurality of the formation-facing surfaces located on a plurality of blade structures.

68. The rotary drag bit of claim 64, wherein the first region comprises a cone region and the second region comprises at least one of the group consisting of a nose region, a shoulder region, and a flank region.

69. The rotary drag bit of claim 68, wherein at least one cutter of the plurality secured on the bit body in the first region exhibits a limited amount of cutter exposure that is less than a limited amount of cutter exposure of at least one cutter of the plurality secured in the second region.

70. The rotary drag bit of claim 68, wherein the second region comprises at least one cutter exhibiting the limited amount of cutter exposure perpendicular to the portion of the formation-facing surface of the blade structure to which the at least one cutter is secured and wherein the plurality of cutters is secured in the cone region on the plurality of blade structures and exhibits a limited amount of cutter exposure which is less than the at least one cutter secured in the second region.

71. The rotary drag bit of claim 68, wherein the second region comprises at least one cutter exhibiting the limited amount of cutter exposure perpendicular to the portion of the formation-facing surface of the blade structure to which the at least one cutter is secured and wherein the plurality of cutters is secured in the cone region on the plurality of blade structures and exhibits a limited amount of cutter exposure which is greater than the at least one cutter secured in the second region.

72. The rotary drag bit of claim 68, wherein the at least one cutter is located in the cone region and comprises the plurality of cutters respectively secured to a plurality of formation-facing surfaces respectively located on a plurality of blade structures and further comprises at least one additional cutter in each of the nose, shoulder, and flank regions, each of the at least one additional cutters exhibiting the limited amount of cutter exposure perpendicular to the portion of the formation-facing surface of a respective blade structure to which each of the at least one additional cutters is respectively secured in the nose, shoulder, and flank regions.

73. The rotary drag bit of claim 72, wherein at least one of the plurality of cutters secured in the cone region has a cutter exposure greater than the at least one additional cutter respectively secured in the shoulder region and the flank region.

74. The rotary drag bit of claim 72, wherein at least one of the plurality of cutters secured in the cone region has a cutter exposure less than the at least one additional cutter secured in the nose region.

75. The rotary drag bit of claim 72, wherein at least one of the plurality of cutters secured in the cone region has a cutter exposure greater than the at least one additional cutter respectively secured in the shoulder region and the flank region.

76. The rotary drag bit of claim 72, wherein at least one of the plurality of cutters secured in the cone region has a cutter exposure less than the at least one additional cutter secured in the nose region and wherein at least one other of the plurality of cutters secured in the cone region has a cutter exposure greater than the at least one additional cutter respectively secured in the shoulder region and the flank region.

77. The rotary drag bit of claim 76, wherein the at least one additional cutter secured in the nose region has a cutter exposure less than approximately 0.2 inch.

78. The rotary drag bit of claim 64, wherein the at least one cutter exhibiting the limited amount of cutter exposure perpendicular to the portion of the formation-facing surface to which the at least one cutter is secured is substantially surrounded by hard facing material.

79. The rotary drag bit of claim 78, wherein the bit body comprises steel and at least one blade structure and the hard facing material is disposed upon a steel surface.

80. The rotary drag bit of claim 64, wherein the superabrasive cutting face of the at least one cutter comprises a peripheral chamfer of a preselected width.

81. The rotary drag bit of claim 64, wherein the first region comprises a cone region and the second region comprises a nose region, a shoulder region, and a flank region and wherein each of the cone, nose, shoulder and flank regions exhibits a limited exposure cutter profile with respect to the amount of cutter exposure perpendicular to a portion of the formation-facing surface exhibited by cutters secured in each of the regions of the bit body as taken in radial cross-section and generally parallel to the longitudinal axis of the bit body.

82. The rotary drag bit of claim 64, wherein the at least one cutter comprises a plurality of cutters, each exhibiting a generally equal amount of cutter exposure perpendicular to a selected portion of an outward face of a leading end to which each of the plurality of cutters is secured.

83. The rotary drag bit of claim 64, wherein the at least one cutter comprises a plurality of cutters, each exhibiting a generally differing amount of cutter exposure perpendicular to a selected portion of an outward face of a leading end to which each of the plurality of cutters is secured.

* * * * *

UNITED STATES PATENT AND TRADEMARK OFFICE

CERTIFICATE OF CORRECTION

PATENT NO. : 6,460,631 B2
DATED : October 8, 2002
INVENTOR(S) : Mark D. Dystra et al.

It is certified that error appears in the above-identified patent and that said Letters Patent is hereby corrected as shown below:

Column 25,
Lines 36-37, after "cutter" change "320C" to -- 328 --

Column 26,
Line 20, after "thereof" and before "Drill" insert -- . --
Line 48, after "20°" delete "0"
Line 67, after "0.2" and before "an" insert -- of --

Signed and Sealed this

Ninth Day of September, 2003

JAMES E. ROGAN
*Director of the United States Patent and Trademark Office*